US007302904B2

(12) United States Patent
Burns

(10) Patent No.: US 7,302,904 B2
(45) Date of Patent: Dec. 4, 2007

(54) GROUND ANCHORS WITH COMPRESSION PLATES

(76) Inventor: Peter Robert Burns, 1 Cheffers St., Moonee Ponds, VI (AU) 3039

( * ) Notice: Subject to any disclaimer, the term of this patent is extended or adjusted under 35 U.S.C. 154(b) by 0 days.

(21) Appl. No.: 11/422,768

(22) Filed: Jun. 7, 2006

(65) Prior Publication Data

US 2006/0236621 A1 Oct. 26, 2006

Related U.S. Application Data

(63) Continuation-in-part of application No. 11/129,177, filed on May 13, 2005, now abandoned, and a continuation-in-part of application No. 10/989,960, filed on Nov. 15, 2004, now abandoned, and a continuation-in-part of application No. 08/923,443, filed on Sep. 4, 1997, now abandoned.

(51) Int. Cl.
*B63B 21/24* (2006.01)
*E02D 5/74* (2006.01)

(52) U.S. Cl. ..... 114/294; 52/155; D12/215

(58) Field of Classification Search ..... 114/294
See application file for complete search history.

(56) References Cited

U.S. PATENT DOCUMENTS 3,070,068 A * 12/1962 Chapman ..... 119/786
3,238,678 A * 3/1966 Barnett ..... 52/155
3,512,319 A * 5/1970 Piacentino ..... 52/160
4,756,128 A 7/1988 Danieli
4,800,843 A * 1/1989 Wendling ..... 119/780
D343,607 S * 1/1994 Martin ..... D12/215
6,298,611 B1 10/2001 Oliver et al.
6,725,872 B2 4/2004 Kindell et al.

FOREIGN PATENT DOCUMENTS

DE 29723219 U1 10/1998
GB 2250758 A1 6/1992

* cited by examiner

*Primary Examiner*—Jesús D Sotelo
(74) *Attorney, Agent, or Firm*—David Pressman

(57) ABSTRACT

Ground anchors, in particular tent stakes (100), comprise one or more inherently flexible tines (110), a ground compression plate (160), and various tie points (420, etc.) for attaching a guy rope or the like to the top of anchor. The compression plate extends perpendicularly or at a large angle to the tine so that when the guy rope pulls on the anchor, the tine will tend to rotate about an underground fulcrum so that the compression plate will press against the ground and help the anchor resist pullout. The anchors are driven into the ground with a hammer or mallet. The tie points include hooks (420), closed holes (520), and swivel types comprising vertical members (810) with restraining, bulbous tops (820). An additional spring tie point (1600) can be inserted into optional lugs (1094, 1096) in the compression plate. The stakes can be driven into the ground vertically, or at an angle for additional holding force in some situations. They can also incorporate angled compression plates (160H, 160I). A curved stake (100I) provides additional holding force in sand or friable soils. The stakes can be manufactured by a variety of means in various materials, such as glass-reinforced or other plastics and forged or stamped metals.

30 Claims, 35 Drawing Sheets

GROUND ANCHORS WITH COMPRESSION PLATES

CROSS-REFERENCE TO RELATED APPLICATIONS

This application is a continuation-in-part (CIP) of application Ser. No. 11/129,177, filed 13 May 2005, now abandoned, and application Ser. No. 10/989,960, Filed 15 Nov. 2004, also abandoned. Application Ser. No. 10/989,960 is a (CIP) of application Ser. No. 08/923,443, Filed 4 Sep. 1997, now abandoned. Application Ser. No. 08/923,443 claims priority of Australian application Ser. No. 36,761/97, filed 4 Sep. 1996.

BACKGROUND

1. Field of Invention

This invention relates generally to ground anchors and in particular to tent pegs or stakes that are used to anchor tents and guy ropes to the ground and to ground or mooring anchors for recreational watercraft, off-road vehicles, and light aircraft.

2. Prior-Art—Tent Stakes

Prior-art tent and guy rope stakes have generally taken the shape of large nails or pegs. They normally secure a tent at two or more places. Some hold the edges of the tent against the ground, and others anchor guy ropes attached to poles at distal ends of the tent. The stakes at the tent's edge are driven nearly vertically into the ground. The guy anchor stakes are driven into the ground at an angle roughly perpendicular to the axis of the rope, typically about 45 degrees. While these stakes successfully secure a tent in mild weather conditions, they are easily dislodged if the tent is exposed to wind or other disturbances. The force of the wind or other disturbance can exert a force that is the reverse the insertion path of stakes at the tent's edge and thus pull them out of the ground. Guy ropes produce a moment of torque around the guy anchor stake's upper end, causing it to rotate and/or bend and tear through the ground. This occurs because, although the lower end of the stake is generally buried in solid soil, the top end, which bears the majority of the load or pull, is in less-compacted soil. As the size and weight of the tent increases, wind load and other forces render the holding force of prior-art stakes insufficient.

In U.S. Pat. No. 5,713,546 (1998), Auspos teaches a foldable holder for beverage containers and other items. The holder comprises a horizontal tray pivotally attached to a stake. In use, the tray is raised to a level position, and the stake is driven vertically into the ground. The tray remains supported above the ground at a convenient height for temporary storage of drinks and other items. For carrying and storage, the tray is folded to a position against the stake. While this apparatus is useful, it has no structure intended for securing a tent edge or guy rope. It is intended only for holding drinks and other items.

Various other ground anchors are known, but these also have poor holding power and other disadvantages, including large size, unwieldiness due to plural tines, and/or a complicated construction.

3. Prior Art—Anchors

Ground or mooring anchors are analogous to tent stakes and are used to anchor a vessel floating in the water to a beach or the like.

Most recreational watercraft, from small dinghies to pleasure craft of up to approximately 15 meters in length, carry one or more stern or sea anchors designed to engage a sea bed. In sheltered waters, it is possible to anchor such craft adjacent to water's edge with the bow anchor secured to the sea bed and a stern or mooring anchor embedded in the sand of the beach and connected to the stem by a hawser, e.g., of hemp or plastic.

The stem or mooring anchor is positioned on the beach some distance from the water's edge and thus is usually is elevated above the water. Thus the angle between the hawser and the ground or water is generally very small. Even though the angle is small, most anchors, such as those sold under the trademarks Danforth by Tie-Down Engineering of Atlanta, Ga., CQR by Lewmar of the U.K., and the like, do not have effective holding power in loose sand. Even though the tension applied to a hawser due to wave or wash action is only of the order of about 5 kg, the constant tugging and release of tugging force can loosen or pull out and drag even a heavy anchor over the surface.

The above anchoring and fixing of vessels is a well-studied problem; thus there have been many attempts to solve the above problems developments in this field.

Lewis, in U.S. Pat. No. 298,867 (1884), similarly shows an anchor comprising a tine that pivots inside and out of a bifurcated shank (FIGS. 2-3). Latham, in U.S. Pat. No. 57,339 (1866), shows an anchor comprising three tines pivotally attached to a bifurcated shank (FIGS. 1-2). Spedden, in U.S. Pat. No. 347,972 (1886), shows an anchor comprising a fluke pivotally attached to a top-plate and a bifurcated shank (FIGS. 3-4). McDougall, in U.S. Pat. No. 445,816 (1890), shows a blade pivotally attached to a bifurcated member, which is in turn attached to a hawser. Starr, in U.S. Pat. No. 493,901 (1892), show a sea anchor comprising a fluke pivotally attached to a top-plate (crown A) and a bifurcated shank (FIGS. 1-2).

Bunje, in U.S. Pat. No. 657,263 (1899), shows a mooring anchor comprising a plurality of tines attached to a square block. However it can pull out easily since it doesn't have a compression or stabilizer plate. Duncanson, in U.S. Pat. No. 730,009 (1902), shows an anchor comprising two tines pivotally attached to a shank (FIGS. 1-2). Neal, in U.S. Pat. No. 957,621 (1909), shows a similar anchor with several blades in the same configuration.

Myers, in U.S. Pat. No. 1,497,693 (1921), discloses an anchor comprising another fluke attached to a bifurcated shank, quite similar to those of several earlier patents described above. A crown (FIG. 6) in normal operation digs into the sea floor, mainly for the purpose of assisting the attached fluke to quickly rotate into position. Bowers, in U.S. Pat. No. 3,505,969 (1968), shows an anchor comprising two flukes pivotally attached to a base plate (FIGS. 1 & 3). Sandberg, in U.S. Pat. No. 4,224,892 (1980), shows a sea anchor. However, the projections used to engage the sea floor have a blunt shape and relatively short length that provides relatively little resistance to forces exerted by the hawser. The main advantage of this anchor seems to be its foldability for easy storage.

Eberline, in U.S. Pat. No. 4,545,318 (1984), shows an anchor comprising four tines and a pivoting plate (FIGS. 1 & 2). The tines extend from the plate's edges. Eberline's is not buried in the sand. Its operation is actuated by the presence of a sea floor obstruction of suitable size; in absence of such an obstruction the anchor will not hold. Danieli, in U.S. Pat. No. 4,756,128 (1987), discloses a ground anchor (FIG. 1) with stabilizing and compression plates and an attachment means for a hawser (FIG. 1). It has only a single spike. Fisher, in U.S. Pat. No. 4,732,105

(1988), shows another sea anchor with several flukes; however it has poor resistance to hawser tension when used as a mooring anchor.

Johnson, in U.S. Pat. No. 5,431,123 (1994), describes an anchoring apparatus having a body which is secured to the ground surface by a rod driven through an aperture in the body. A driving device with a hawser attachment mechanism is used as a handle to drive a rod (optionally with a spade-like compression plate) into sand. A loop-like member at the end of the driving device is then slipped over the protruding rod, thereby indirectly securing the hawser to the rod. It has two moving parts, 25 and 27. If these become jammed or weakened through wear or the presence of foreign matter they could render the apparatus inoperative. Its rather complex design makes it somewhat costly to manufacture.

Militello, in published patent application 2003/0024460, shows a beach anchor comprising a triangular member with a hole for a hawser and a hand hold for facilitating insertion into the beach. However this design has relatively low holding ability due to its simple design and since its hawser hole is too low for the anchor to be pushed in deeply.

Some of the foregoing patents involve pivoting flukes. These seem to suffer from the disadvantage that sand, rocks, or other material stirred up from the sea floor can become jammed in the pivoting mechanism and cause the anchor to lock up.

All of these anchors are relatively complicated and/or have relatively poor resistance to hawser tension and thus are not maximally effective in mooring a vessel, or are subject to entanglement or breakage, or have other disadvantages that make them less than optimally suitable for use as a mooring anchor.

A related area of prior art is that where ropes and lines are connected to stakes and other anchoring devices for attaching objects to the ground.

Mazur, in U.S. Pat. No. 2,870,884 (1957), shows a ground anchoring device in which three spikes are driven through apertures in a plate. A hawser is then attached to a bar rigidly mounted between two parallel ribs on the top surface of the plate. When the hawser angle is higher than horizontal, a situation that Mazur envisions, the plate does not interact with the stakes to improve anchoring performance. Where the hawser is attached to a boat and the hawser slopes down from the anchor, i.e., the boat is significantly below the level of the anchor, the hawser can rub against the edge of the plate (FIG. 4) due to wave motion, causing the hawser to wear.

Lee et al., in U.S. Pat. No. 4,315,387 (1980), discloses a ground anchor stake device. It has of straight and curved tines, the two sets of tines being pivotally attached to each other. The straight tines are first driven into the ground at an angle, and the curved tines are pressed into the ground in front of the straight tines.

Kinsey, in U.S. Pat. No. 4,679,369 (1985), describes a device using a series of stakes driven into the ground at the same angle. The stakes are made equidistant by using a series of spacer bars, each with a hole at each end to fit around a stake. Adjacent spacer bars are separated by a cylindrical collar fitted around their common spike. The final stake also has a collar, flat against the ground, to which a hawser is attached. Assembly of the device is somewhat complex. Its holding power is mainly due to the use of several stakes. The spacer bar arrangement assures that the force exerted by the hawser is distributed equally among the stakes. There is a potential for losing or misplacing the various components if they are stored carelessly. Speed of installation and retraction, especially when several stakes are to be used in series, could be an issue.

Wendling, in U.S. Pat. No. 4,800,843 (1987), discloses a multi-stake tether with a swiveling top for tethering animals. This swiveling capability is not relevant to mooring and anchoring applications. Horowitz, in U.S. Pat. No. 4,936,194 (1989), discloses a simple boat-tying stake with a handle. Mestas, in U.S. Pat. No. 4,960,064 (1989), discloses a single stake boat ground anchor, including a small underground-deployable stabilizing 'wing' to increase resistance to being pulled out of the ground. The wing, however, is small, relative to the stake, so that it lacks optimal stabilizing effect. Roberts, in U.S. Pat. No. 5,243,795 (1991), discloses a staking device for aircraft securement. Three stakes are driven into the ground at various angles through bores in a cylindrical hub which sits on the ground. The hub has a loop affixed to its top, allowing a hawser to be tied to it. The stakes are driven through the hub, fixing the block in place. Travioli, in U.S. Pat. No. 5,460,112 (1993), discloses a rack intended to be placed on a beach near the waterline, to which a boat's bow is attached. The rack has a single sand-embedded plate. The whole assembly is somewhat complex and ungainly, and if the roller (FIG. 2) becomes jammed, it could abrade the bottom of the boat due to lateral wave motion. A separate tool, such as a rock or hammer, is needed to drive the plate into the ground since the plate (FIG. 2) has a narrow upper lip to which it is not convenient to apply hand or foot pressure.

Other sand or beach devices are known.

Peterson, in U.S. Pat. No. 2,662,342 (1953), discloses a lawn border edging component. While comprising three tines and a plate, it contains no attachment means for a hawser, since it is not intended to be used as an anchoring device of any kind but rather as an in-ground guide track for lawn edge trimming tools. Pitt, in U.S. Pat. No. 4,334,661 (1978), shows another drink holder. Unlike Auspos, it has a plate perpendicular to its single spike to provide support for the user's drink. While it could be used as a ground anchor, the plate is too small to provide any compressive force onto the soil and is not intended to withstand horizontal forces such as are exerted by a hawser attached to a boat or other moored object.

Finally, Hart, in U.S. Pat. No. 5,360,189 (1994), discloses an outdoor bag holding stand. It has two tines that are pressed into the ground, but the presence of cross-members 13 and 16 allows the upright tines to be inserted to only a fraction of their length into the ground. Even if it were used as an anchoring device, the long lever arm constituted by the portion of the tines above ground would cause it to be easily pulled out by a horizontal force upon its upper loop 11. It works as a bag holder in which the forces on the upper loop are mostly downward, rather than horizontal as in the anchoring application.

SUMMARY

In accordance with one or more aspects of one embodiment of the invention, a ground anchor has a single narrow tine with a compression plate attached orthogonally to the upper part of the tine. The tine is driven into the ground until the plate contacts the ground. When the top of the tine is under load, e.g., due to pull from a guy line or a tent canvas, the plate compresses the ground around the anchor, limiting movement of the top of the anchor. In response to this limited movement, the upper portion of the anchor flexes slightly due to the inherent springiness of the tine and the depth-limited movement of the lower part of the tine. When the load is removed, the anchor springably returns to its original condition. The lower portion remains secured in the ground, thus reducing the anchor's tendency to slip out or tear the ground into which it is inserted. The narrow tine, and its inherent flexibility, combine to ensure that great stiffness or rigidity, two attributes that cause a prior-art stake to fail, are reduced.

In accordance with one or more other aspects, a ground anchor has a plurality of parallel spaced tines for insertion into the ground. The tines are secured at their upper ends to a horizontal mounting member, with their lower ends sharpened to allow easy insertion into the soil. The mounting member includes a plate or plates. The plate(s) may be a vertical compression plate (parallel to the plane of the tines so that it will compress the soil in front of the tines mostly horizontally in the direction of hawser pull), or a horizontal plate (perpendicular to the plane of the tines so that it will tend to compress the soil in front of the tines downward), or both. A loop or hole is attached to or integral with either the mounting member or the horizontal plate to allow attachment of a hawser. Several embodiments are shown in the figures and described in detail below. A number of materials may be used, including mild steel, stainless steel, aluminum, Glass-fiber Reinforced Plastic (GRP), any other plastics or suitable material. GRP tines are somewhat flexible and act in a spring fashion under tension as described more fully below. These ground anchors may be used in various soils; including sand, clay, loam, or other matter.

DRAWINGS—FIGURES

FIG. 28(*b*) shows a perspective view of the anchor of FIG. 28A from below.

DRAWINGS—REFERENCE NUMERALS

| | |
|---|---|
| 10, 10L, 10R | Tine |
| 12 | Tip |
| 14 | Member |
| 16 | Plate |
| 18 | Plate |
| 20 | Side |
| 22 | Member |
| 24 | Member |
| 26 | Plate |
| 28 | End |
| 30 | Pin |
| 32 | Aperture |
| 34 | Member |
| 36 | Plate |
| 38 | Member |
| 40 | Member |
| 41 | Plate |
| 42 | Loop |
| 44 | Member |
| 46 | Plate |
| 48 | Termination |
| 50 | Shackle |
| 52 | Region |
| 54 | Region |
| 56 | Region |

-continued

| | |
|---|---|
| 58 | Region |
| 61 | Member |
| 62 | Member |
| 64 | Hammer |
| 66 | Stop |
| 68 | Shaft |
| 100 | Stake |
| 110 | Tine |
| 120 | Bend |
| 130 | First descending portion |
| 135 | Second descending portion |
| 140 | Tip |
| 150 | Tip |
| 160 | Plate |
| 170 | Attachment |
| 200 | Hook |
| 300 | Fulcrum |
| 310 | Compressed region |
| 320 | Compressed region |
| 420 | Hook |
| 440 | Top |
| 442 | Hole |
| 500 | Top |
| 505 | Tine |
| 510 | Tie point |
| 515 | Cut-out |
| 520 | Tie point |
| 530 | Tie point |
| 600 | Neck |
| 610 | Top |
| 700 | Arm |
| 800 | Joint |
| 810 | Neck |
| 820 | Top |
| 900 | Top |
| 910 | Hole |
| 920 | Hole |
| 930 | Bend |
| 940 | Hole |
| 950 | Hole |
| 960 | Gusset |
| 970 | Weld |
| 1000 | Tine |
| 1010 | Tine |
| 1020 | Bend |
| 1030 | Bend |
| 1040 | Bend |
| 1050 | Attachment |
| 1060 | Attachment |
| 1070 | Hook |
| 1080 | Bar |
| 1090 | Attachment |
| 1092 | Attachment |
| 1094 | Lug |
| 1096 | Lug |
| 1100 | Extension plate |
| 1105 | Lug |
| 1110 | Lug |
| 1115 | Stop |
| 1120 | Stop |
| 1125 | Stop |
| 1130 | Stop |
| 1135 | Notch |
| 1300 | Plate |
| 1310 | Stake |
| 1315 | Foot |
| 1320 | Support |
| 1325 | Attachment |
| 1330 | Gusset |
| 1340 | Hole |
| 1350 | Hole |
| 1600 | Spring |
| 1610 | Finger |
| 1620 | Finger |
| 1630 | Finger |
| 1640 | Finger |
| 1650 | Bend |
| 1660 | Bend |
| 1670 | Ridge |

-continued

| | |
|---|---|
| 1800 | Rope |
| 3200 | Tine |
| 3210 | Hole |
| 3230 | Brace |
| 3240 | Top |
| 3250 | Hole |
| 3270 | Fillet |
| 3280 | Fillet |
| 3300 | Tine |
| 3310 | Hole |
| 3320 | Plate |
| 3340 | Brace |
| 3400 | Tine |
| 3410 | Tip |
| 3440 | Hole |
| 3450 | Hole |
| 3455 | Fillet |
| 3460 | Termination |
| 3500 | Tine |
| 3505 | Shaft portion |
| 3510 | Ring |
| 3560 | Handle |
| 3570 | Hook |
| 3580 | Stops |

DESCRIPTION—FIRST EMBODIMENT—FIGS. 1-3

Figure 1:
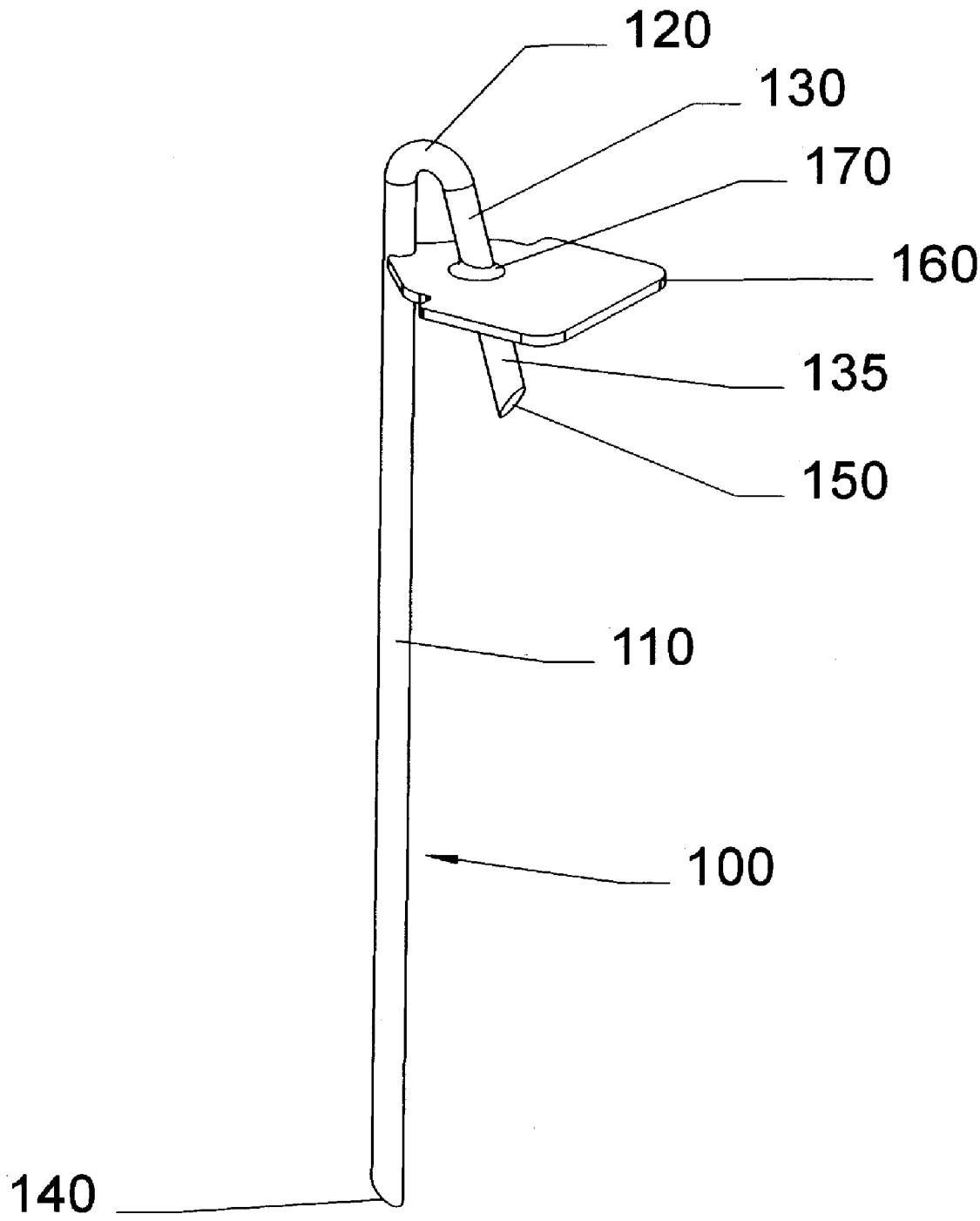
FIG. 1 is a perspective view of a first embodiment of a ground anchor of the invention. It comprises a straight spike having a bight top part with an attached horizontal plate.

FIG. 1 shows a perspective view of a ground anchor, peg, prong, or stake 100 according to one embodiment of the invention.

Figure 4:
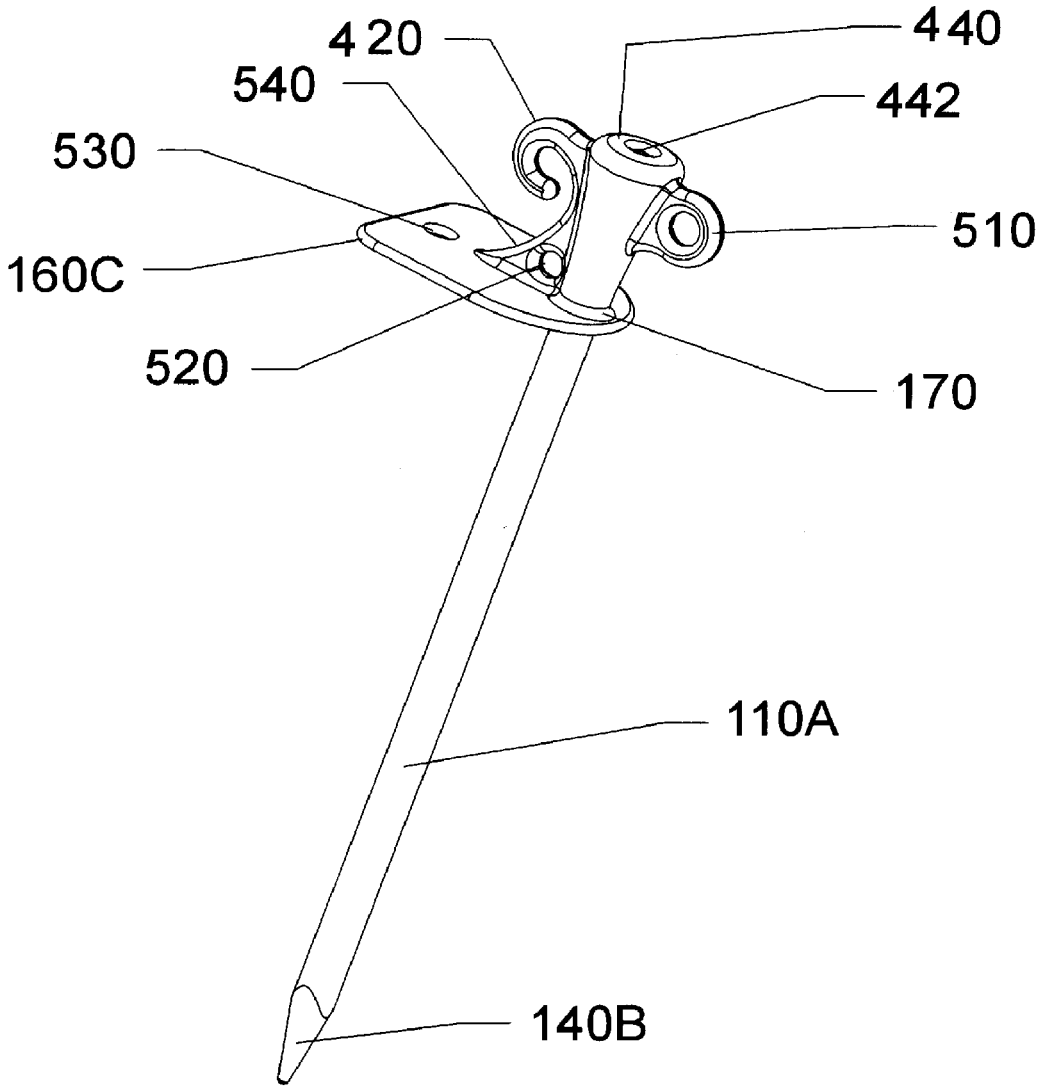
FIG. 4 shows a first alternative embodiment comprising a peg with loops suitable for use in sand.

Stake 100 is formed into an inverted "J" shape comprising an ascending portion or tine 110, a bend or bight loop portion 120, and first and second coaxial descending portions 130 and 135, respectively. In this embodiment, portions 110, 130, and 135 are straight. A first elongated tine, comprising ascending portion 110 has a first sharpened tip 140 that facilitates insertion into the ground (not shown). Tip 140 can be wedge-shaped with a single flat side as shown in FIG. 1, with two flat sides as in FIG. 2 (140A), or pointed as shown in FIG. 4 (140B), for example. Portions 130 and 135 can also be bent 150 degrees so as to form a 30-degree angle with tine 110.

Descending portion 135 forms a second shortened tine, generally contiguous with portion 130, below a plate 160 (described below). Portion 135 terminates in a second sharpened tip 150. When inserted into the ground (not shown), portion 135 prevents rotation of stake 100 around the axis of tine 100.

Tine 100 is round, although elliptical, square, rectangular, star-shaped, and other cross-sections will work as well. The diameter of tine 100 is 8 mm and its length from tip 140 to bend 120 is 30 cm, although other dimensions can be dictated by the use to which the stake is put. The lengths of descending portions 130 and 135 are 5 cm. Stake 100 and plate 160 are made of steel, aluminum, glass-reinforced plastic (GRP), other engineering plastics, a combination of two or more of these, or another structural material.

A compression plate (plate) 160 is secured about half-way down descending portions 130 and 135 (if present, see below) by a weld, adhesive joint, or similar attachment 170. The plane of plate 160 is perpendicular to the axis of ascending portion 100. In one embodiment, plate 160 was about 8 cm square by 2 mm thick. As with tine 100, plate 160 is made of steel, aluminum, GRP, or another structurally strong material which can be bonded to portion 130. Plate 160 and bight loop or portion 120 of the stake above plate 160 form a closed attachment loop, eye, noose, or hawser tie opening. As shown best in FIG. 3, the hawser tie opening is spaced above the plate by a distance that is smaller than the length of the plate on the forward or right side of the loop. Tine 110 is straight, or curved, as described below. The inherent flexibility of tine 110 is determined by its diameter, its length, and the material of which it is made. The material of which tine 110 is made is normally stiff. The relatively long length and small diameter results in a structure which is springable under heavy load, but returns to its original shape when the load is removed.

Figure 2:
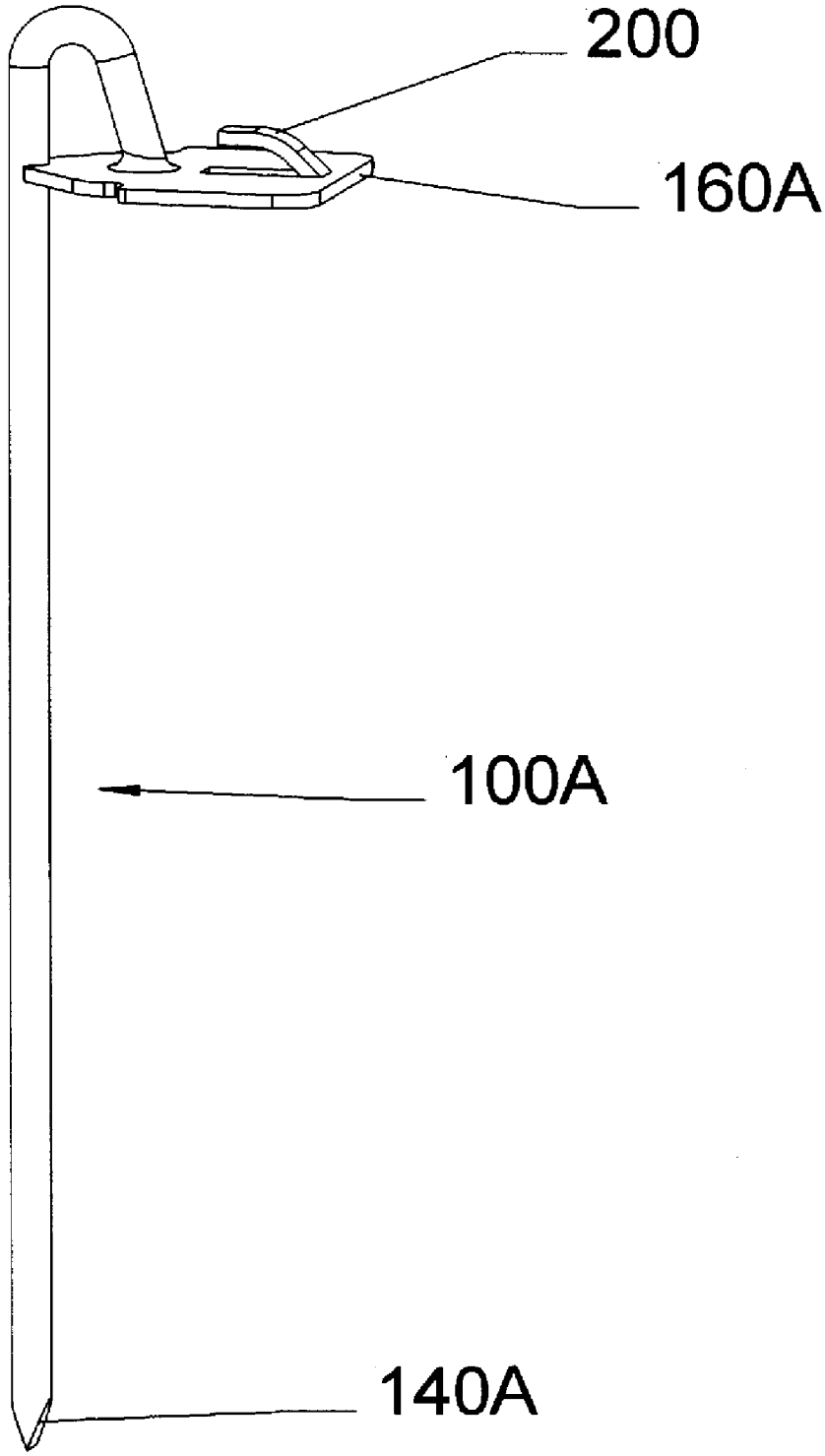
FIG. 2 shows the embodiment of FIG. 1 with an added hook.
Figure 3:
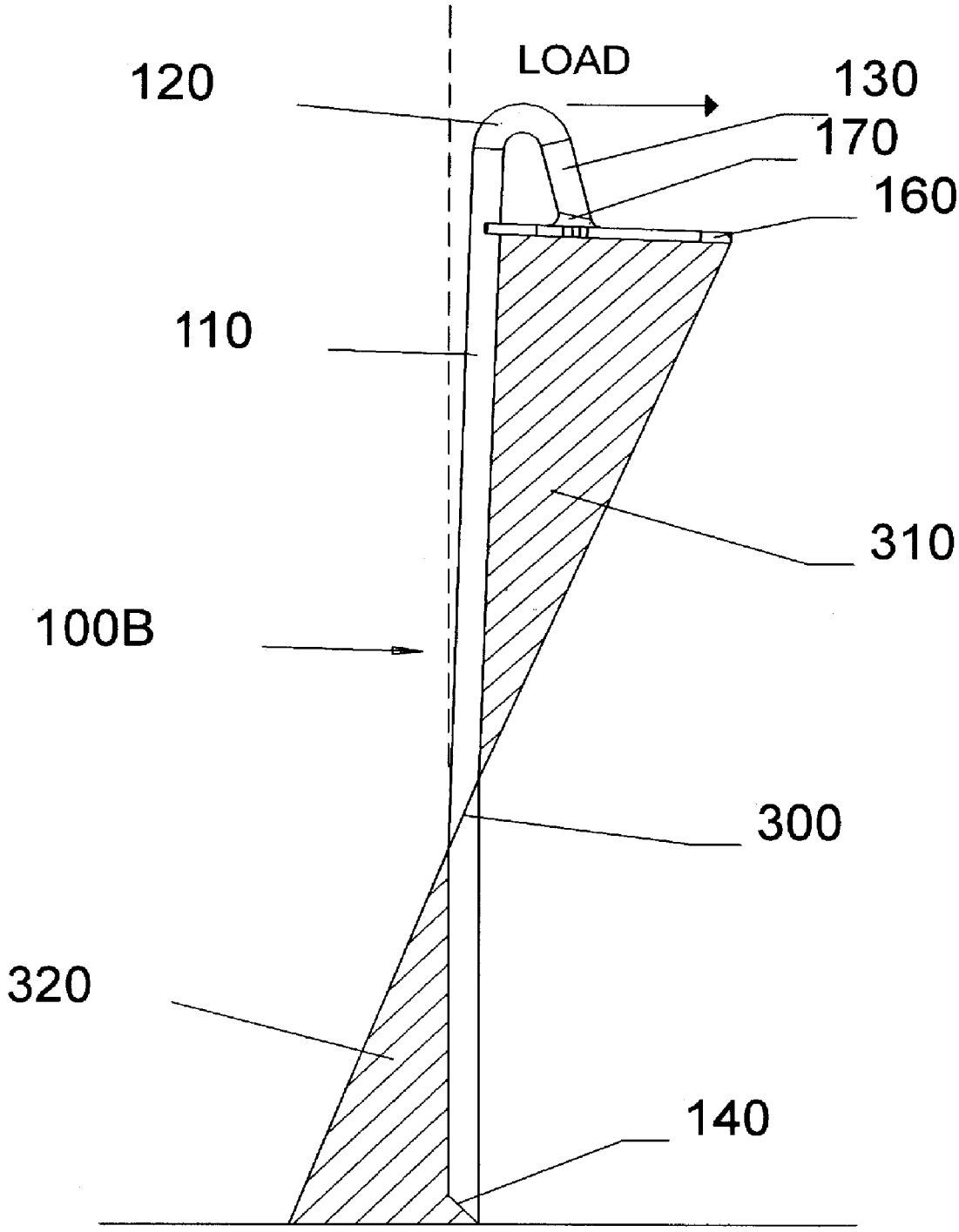
FIG. 3 shows a side view of the embodiment of FIG. 1 under load, and a region of soil compression beneath the compression plate and behind the tine.

FIGS. 2 and 3 show modifications of the first embodiment. In FIG. 2, a hook or lug 200 has been added to or punched partially out of plate 160A, descending portion 135 has been eliminated, and tip 140A is a wedge with two flats. In FIG. 3, stake 100B is the same as stake 100 in FIG. 1, except descending portion 135 has been eliminated.

The embodiments in FIGS. 1 to 3 can be made of mild steel with a corrosion-resistant coating such as hot-dipped galvanizing. They are used for tent staking in all soil types. (Bamboo or timber material would make ideal tines for anchors with push on tops that are to be used in sand.)

OPERATION—1ST EMBODIMENT—FIG. 3

The user normally inserts tine 110 (FIG. 3) of stake 100B vertically into the ground (not shown), as far as possible by hand force. Then the stake is driven home by hammering the top of bend 120, forcing tine 110 downward into the ground until plate 160 rests firmly on the ground, slightly compacting the soil beneath. Sharpened tip 140 (and 150 from FIG. 1, if present) facilitates insertion. A rope, cable, or hawser is secured to the eye between plate 160 and bend 120.

Because of its relatively small diameter, stake 100 is slightly flexible. When a load force is applied to stake 100 in the direction shown by the arrow, this force tends to rotate stake 100 clockwise around a fulcrum point 300. The upper portion of tine 110 deviates from its previously straight condition, indicated by the dashed line extending upward from fulcrum 300. When surrounded by tightly compacted soil, any movement of stake 100 is limited to a compaction region 310 above fulcrum point 300. Tine 110 flexes as much as five degrees under extreme-pull load conditions, and then springably returns to its original condition when the load is removed. Thus two factors (compaction area 310 and the springiness of the tine) combine to increase the efficiency of stake 100 over prior-art designs.

Plate 160 also compresses the soil to limit movement, while inherently flexible tine 110 allows whatever movement is induced by the load force to be dissipated above fulcrum point 300. Shaded areas 310 and 320 respectively indicate first and second compressed regions of soil beneath plate 160, and behind tine 110 which resist the torque around fulcrum point 300. The portion of tine 110 lying below fulcrum point 300 does not move or flex under normal load conditions. Stake 100 is thus rendered immobile in the direction of the applied load.

If present, descending portion 135 lying beneath plate 160 is also forced into the ground, and acts to prevent rotation of stake 100 about the axis of tine 110.

Stake 100 can be used to prevent fly-away of a tent edge (not shown). Stake 100 is inserted into the ground approximately 15 cm from the tent edge. A rope or line (not shown) is attached to each generally available grommet or tab on the tent edge. The other end of the rope is secured to stake 100. In this configuration, the load on stake 100 is nearly horizontal and a secure tether results.

If stake 100 is used to secure a guy or hawser (not shown), the rope is passed through the eye of stake 100. Stake 100 is oriented so that the axis of the guy rope lies in the plane containing tine 110 and descending portion 130 of stake 100. The rope is arranged to pull in a direction away from tine 110 and toward descending portion 130. The tension in the rope creates a clockwise moment of torque centered near fulcrum 300. This torque acts to force the outermost edge of plate 160 downward, thereby compressing the ground below plate 160 in region 310. The torque also forces tine 110 against the ground in region 320 in a direction away from the rope's pull. Alternatively the rope can be hooked over hook 200 of FIG. 2.

Angled Insertion of Stake 100

For acute vertical angle loads, tine 110 can be inserted into the ground at an angle such that tip 140 lies closer to the anchoring force, and bend 120 lies farther away. Stake 100 is still fully inserted into the ground, up to the bottom of plate 160.

In this position, plate 160 is forced downward into the ground and plate 160 and tine 110 compress the ground in the direction of the applied force. The result is a stronger anchorage than would be obtained with a vertical insertion of tine 110 in this situation.

DESCRIPTION AND OPERATION—1ST ALTERNATIVE EMBODIMENT—FIG. 4

A first alternative embodiment is shown in FIG. 4. A compression plate 160C is secured to tine 110A by a weld, crimp, glue, threads, or other attachment at joint 170. Joint 170 may be either above or below plate 160C, or extend above and below plate 160C. Instead of a joined plurality of components, the stake of this embodiment can be cast as a unit. Tine 110A terminates in a sharpened tip 140B. However a wedge-shaped tip such as 140 (FIG. 1) or 140A (FIG. 2) can also be used.

The top portion of the stake above plate 160C includes a gusset 540 and tie points comprising a hook 420 and tie-point holes 510, 520, and 530. The top 440 of the stake is flat to accommodate striking of the stake by a hammer or mallet. Top 440 optionally includes a hole 442 for insertion of a rod, for example a flag mast. In one embodiment, the diameter and depth of hole 442 are 0.5 cm and 2 cm, respectively.

As in the first alternative embodiment, this stake can be driven into the ground by force applied by the user's foot, or by hammer blows to top 440.

One version of this embodiment is made of GRP. It is best used for tent staking in sand or friable soil.

DESCRIPTION AND OPERATION—2D ALTERNATIVE EMBODIMENT—FIG. 5

Figure 5:
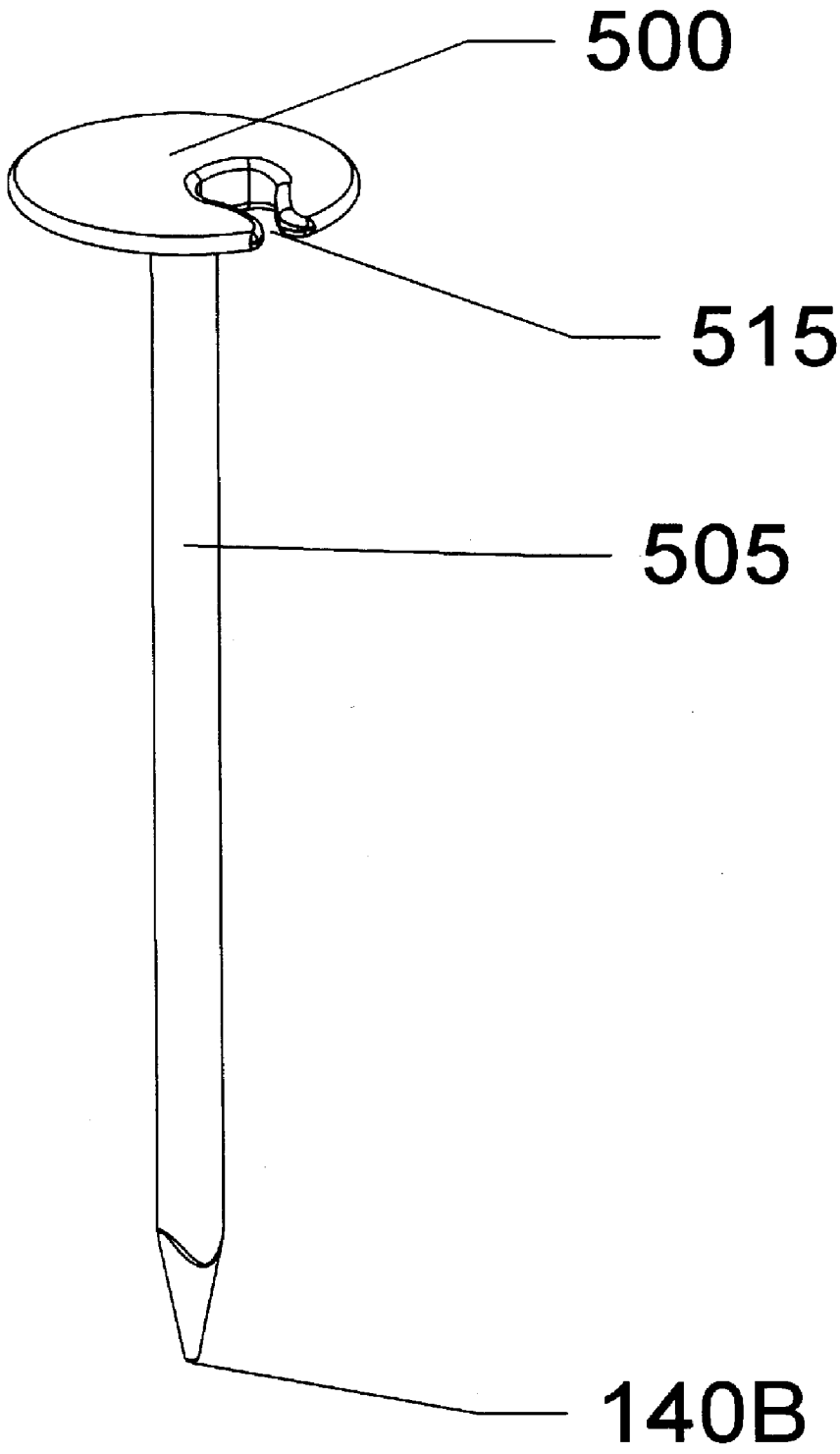
FIG. 5 shows a second alternative embodiment comprising a peg with a simple top.

FIG. 5 shows a simple design for use in horizontal pegging of tent bases, ground sheets, and similar light items. A flattened top 500 is rigidly attached to a tine 505. The cross-section of tine 505 can be circular, elliptical, hexagonal, or another shape. Tine 505 terminates in a sharpened tip 140B. As in the first embodiment, tip 140B can alternatively be wedge-shaped. Top 500 further includes a keyway-shaped cut-out 515. This stake can be made of GRP or other plastics, mild steel, or aluminum. The diameter and length of one exemplary tine are 8 mm and 20 cm. The diameter of the top of this tine is 50 mm. Other dimensions can be used, depending on the application for the peg.

A line (not shown) can optionally be secured by looping around tine 505 then passing upward through cut-out 515. The line is then pulled taut and tine 505 is pushed to or slightly into the ground by applying force to top 500.

Figure 6:
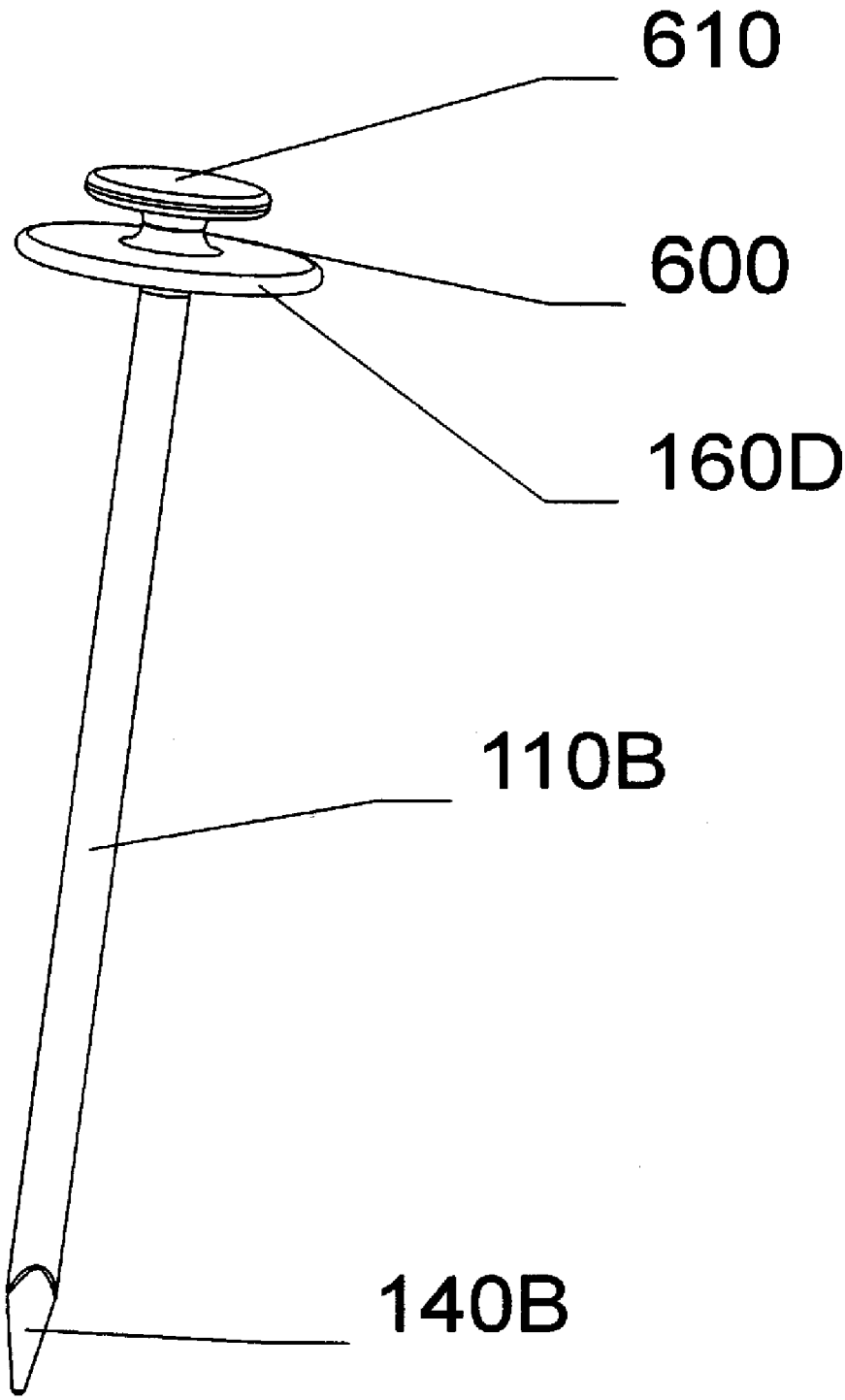
FIG. 6 shows a third alternative embodiment comprising a plastic circular peg.
Figure 7:
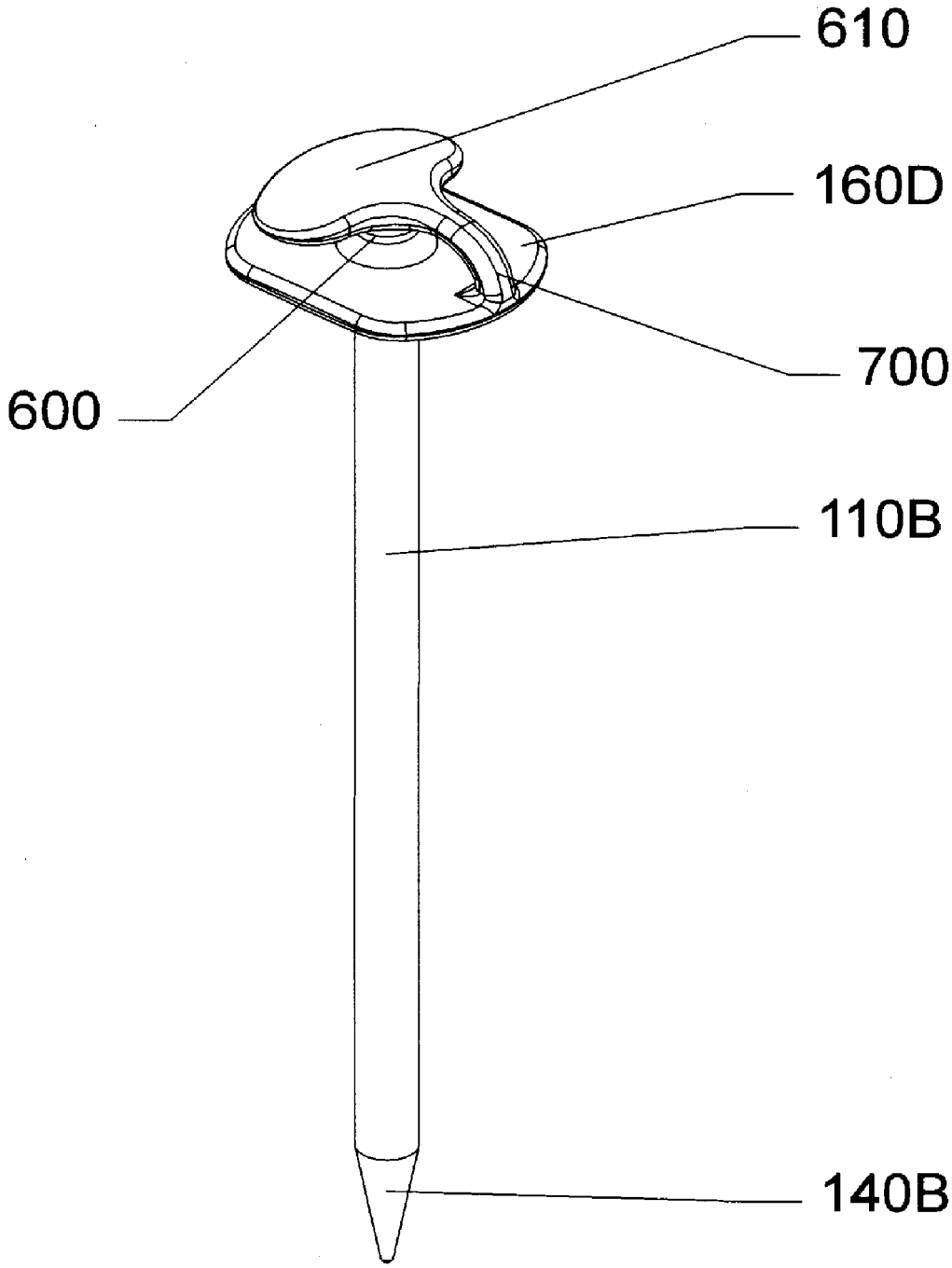
FIG. 7 shows a fourth alternative embodiment comprising a plastic circular peg with a tie loop.

DESCRIPTION AND OPERATION—3D & 4TH FOURTH ALTERNATIVE EMBODIMENTS—FIGS. 6 and 7

Third and fourth alternative embodiment are shown in FIGS. 6 and 7. A circular plate 160D (FIG. 6) is secured to tine 110B by one or more of the attachment means described above. Neck 600 extends upward from plate 160D to form a loop-over tie point. Neck 600 is topped or capped by a larger top 610. The upper side of top 610 is flat or nearly-flat. In one embodiment, the diameter of neck 600 is one centimeter, while that of top 610 is about 3 cm. A rope having a loop end (not shown) is looped over top 610 and secured to neck 600 so that the rope is free to swivel around the axis of the stake, yet it is prevented from slipping off by top 610.

In FIG. 7, a tie arm 700 extends from top 610 downward to plate 160D. Top 610 in FIG. 6 or 7 can be used as a hand or foot platform for forcing stake 100E into the ground. Alternatively, top 610 can be struck with a hammer or mallet. As above, the stake terminates in a sharpened wedge or point 140B at its bottom end. The combination of top 610 and arm 700 allows the rope (not shown) to be attached at a more vertical angle since the rope will be prevented from slipping off of top 610 by arm 700.

The stake of this embodiment can be used to secure beach shelters and lightweight tents in sand/friable soil and larger tents and the like in sand and firmer soils. It is well-suited to manufacture by molding in GRP, other engineering plastic, or forged or cast aluminum or other metal. It is best suited for staking out most tent bases, tents and beach sun shelters.

Plate 160D has a rectangular shape with rounded corners. Alternatively other shapes can be used, such as oval, triangular, square, rectangular, hexagonal, etc.

DESCRIPTION AND OPERATION—5TH ALTERNATIVE EMBODIMENT—FIG. 8

Figure 8:
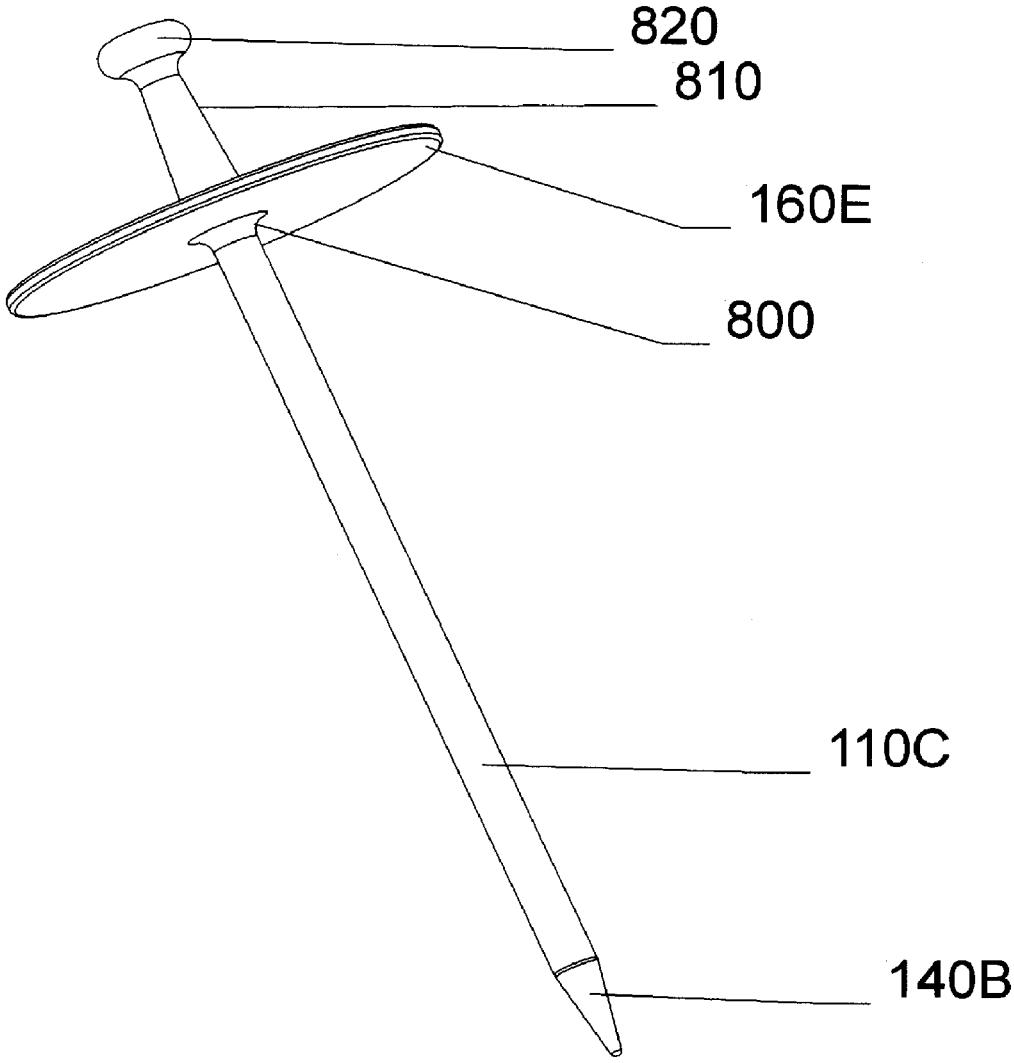
FIG. 8 shows a fifth alternative embodiment comprising a circular or 360° compression plate.

FIG. 8 shows a fifth alternative embodiment. Compression plate 160E is shown as circular, but again may be square, triangular, elliptical, or another planar shape. The circular shape provides compression of the ground in all directions around the stake. Plate 160E is secured to tine 110C at joint 800 by one or more of the attachment means described above. The stake continues upward above plate 160E in a neck 810 and a bulbous top 820. Top 820 permits a tie-point rope (not shown) secured around neck 810 to swivel around the axis of the stake, while preventing the rope from slipping off the stake. Hammer blows applied to the top of bulb 820 drive the stake into the ground. As with the previously-discussed embodiment, the stake terminates at its bottom end in a sharpened wedge or point 140B, although either of tips 140 or 140A can be used as well. Tine 110C can be of circular, elliptical, or other cross-section. Other-than circular cross-sections cause the stake to resist rotating around the axis of tine 110C This embodiment of the stake is also amenable to manufacture in GRP, other engineering plastics or forged metal.

This embodiment is best suited to heavy duty anchoring in sand or friable soil. For example, it can be used for securing a beach umbrella from fly-away. This stake can be used to secure an animal (not shown), for example. A rope (not shown) is tied to a swivel fitted to 810 (not shown). The other end of the rope is attached to the animal's collar (not shown). The animal is free to move within its prescribed radius without winding the rope around the stake.

DESCRIPTION AND OPERATION—6TH ALTERNATIVE EMBODIMENT—FIG. 9

Figure 9:
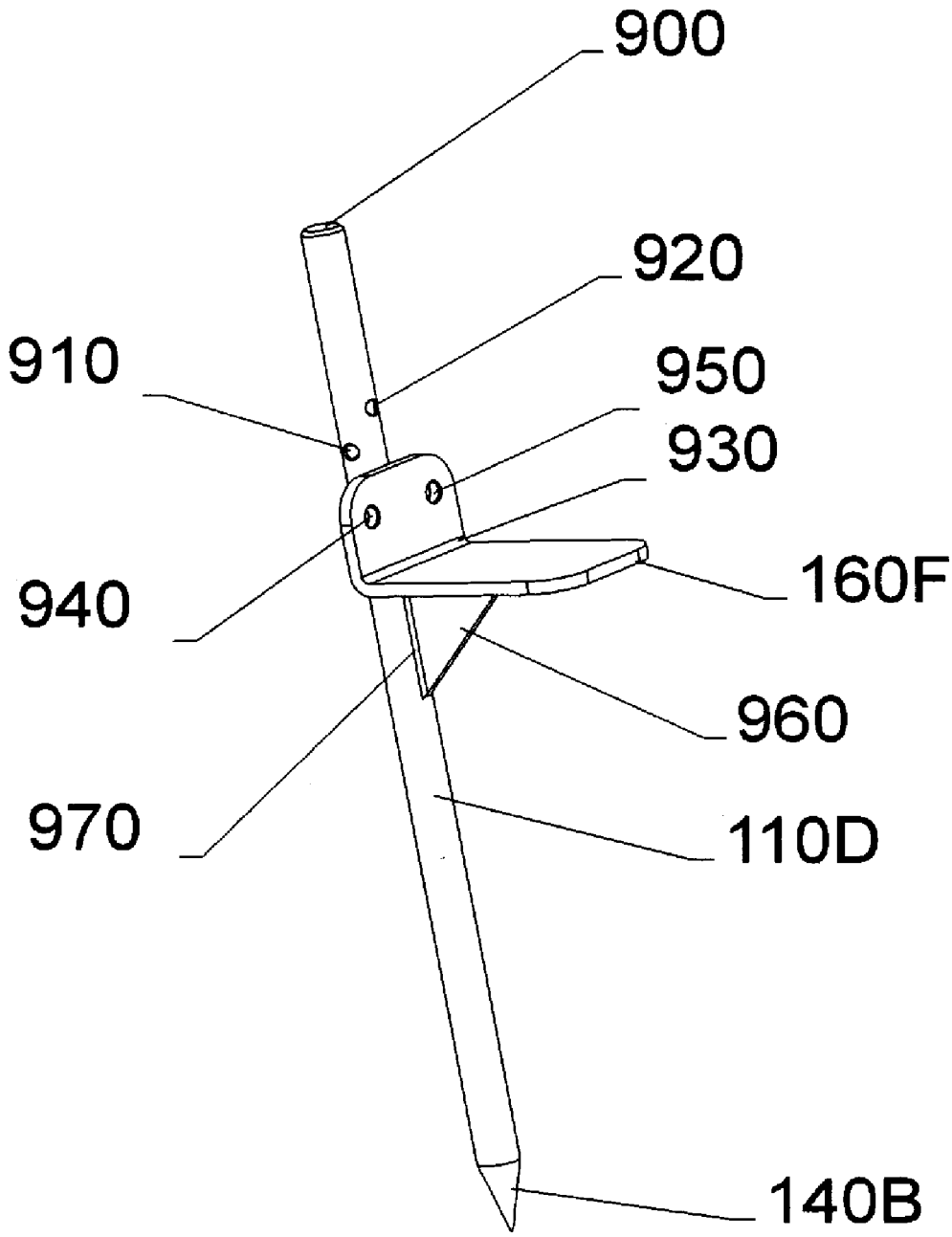
FIG. 9 shows a sixth alternative embodiment comprising a spike with a rectangular compression plate spaced below the top.

FIG. 9 shows a sixth alternative, industrial-grade embodiment. It includes a single tine 110D with a flat top 900. As above, the length and diameter of tine 110D in one embodiment are 50 cm and 30 mm, respectively. The actual size will vary depending on the load to be anchored. Holes 910 and 920 provide convenient tie point points. A sharpened point 140B facilitates insertion into the ground (not shown).

A rectangular plate 160F incorporates a right-angle bend 930, and includes further tie point holes 940 and 950. In one embodiment, plate 160F is 6 cm wide and extends about 8 cm away from tine 110D. The upper portion of plate 160F is about 5 cm high. Plate 160F is affixed to tine 110D by a weld or other attachment (not shown). Plate 160F is supported from below by a gusset 960 secured to tine 110D by an attachment or weld 970, and further attached to the bottom of plate 160F by another weld or attachment (not shown).

Tine 100D is driven into the ground by hammer blows to top 900 until plate 160F is in contact with the ground. One or more hawsers are tied through one or more of holes 910, 920, 940, and 950.

I contemplate use of this embodiment for heavy-duty applications such as support for vineyard "straining posts", for example. It can be made of mild steel, another metal, reinforced plastic, etc.

DESCRIPTION AND OPERATION—7TH ALTERNATIVE EMBODIMENT—FIG. 10

Figure 10:
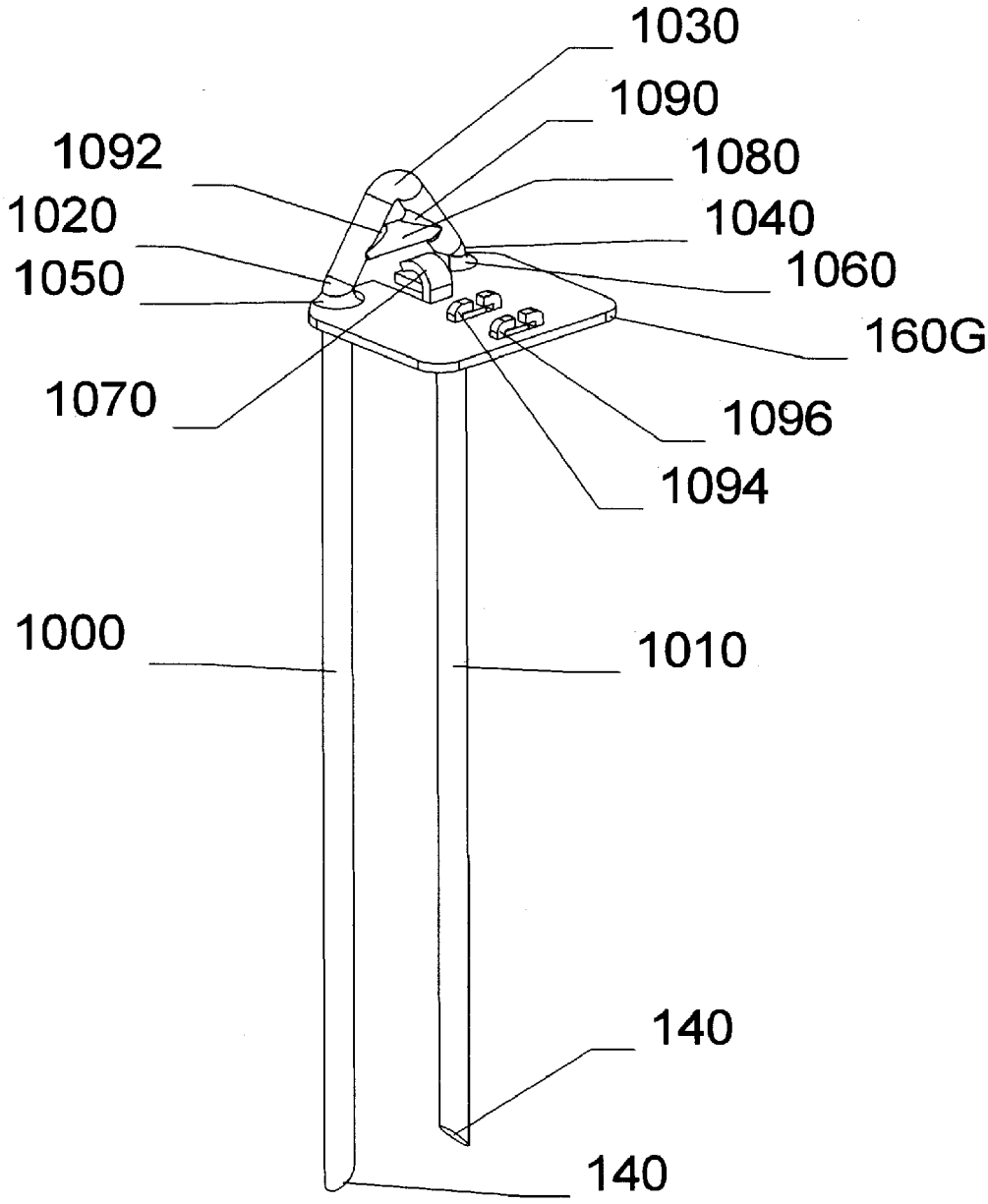
FIG. 10 shows a seventh alternative embodiment employing two tines.

FIG. 10 shows a seventh alternative embodiment. This stake comprises two tines 1000 and 1010 formed from a single rod containing bends 1020, 1030, and 1040 which together form a 180-degree bend or bight portion connecting tines 1000 and 1010 together. Bends 1020 and 1040 are about 33.5 degrees from their respective tines 1000 and 1010, and bend 1030 forms an angle of about 67 degrees. A square plate 160G is attached to tines 1000 and 1010 near bends 1020 and 1040 by welds or attachments 1050 and 1060, respectively. Bends 1020 and 1040 are shown as about 30 degrees with respect to the lower portions of tines 1000 and 1010. The internal angle of bend 1030 depends on the spacing of tines 1000 and 1010 and is shown as about 80 degrees. These angles will vary slightly, depending on the size of stake 100H. A tie-off bar 1080 is welded to tines 1000 and 1010 by welds or attachments 1090 and 1092 between bends 1030 and 1040, and 1020 and 1030, respectively. Plate 160G incorporates an optional hook 1070.

Plate 160G further includes optional lugs 1094 and 1096 for securing a spring, as described below. Plate 160G can be stamped in a single operation.

The presence of two parallel tines 1000 and 1010 ensures that this stake will not rotate. The addition of a second tine also increases the holding power of stake 100H over one with a single tine.

This embodiment is intended to be used for heavy duty tent, tarpaulin, or similar staking in sand, friable soil, or firm ground, particularly in windy conditions, but can be use in many other applications.

DESCR. & OPERATION—8$^{TH}$ & 9TH ALT. EMBODS.—EXPANSION PLATE—FIGS. 11 & 12

Figure 11:
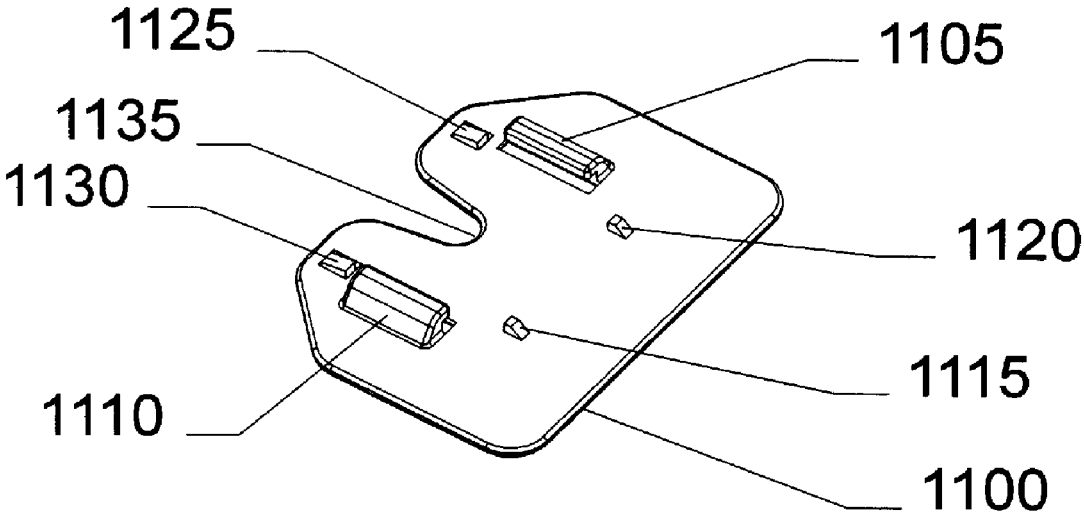
FIG. 11 shows an eighth seventh alternative embodiment, an attachment plate for a steel straight 90 degree ground peg.
Figure 12:
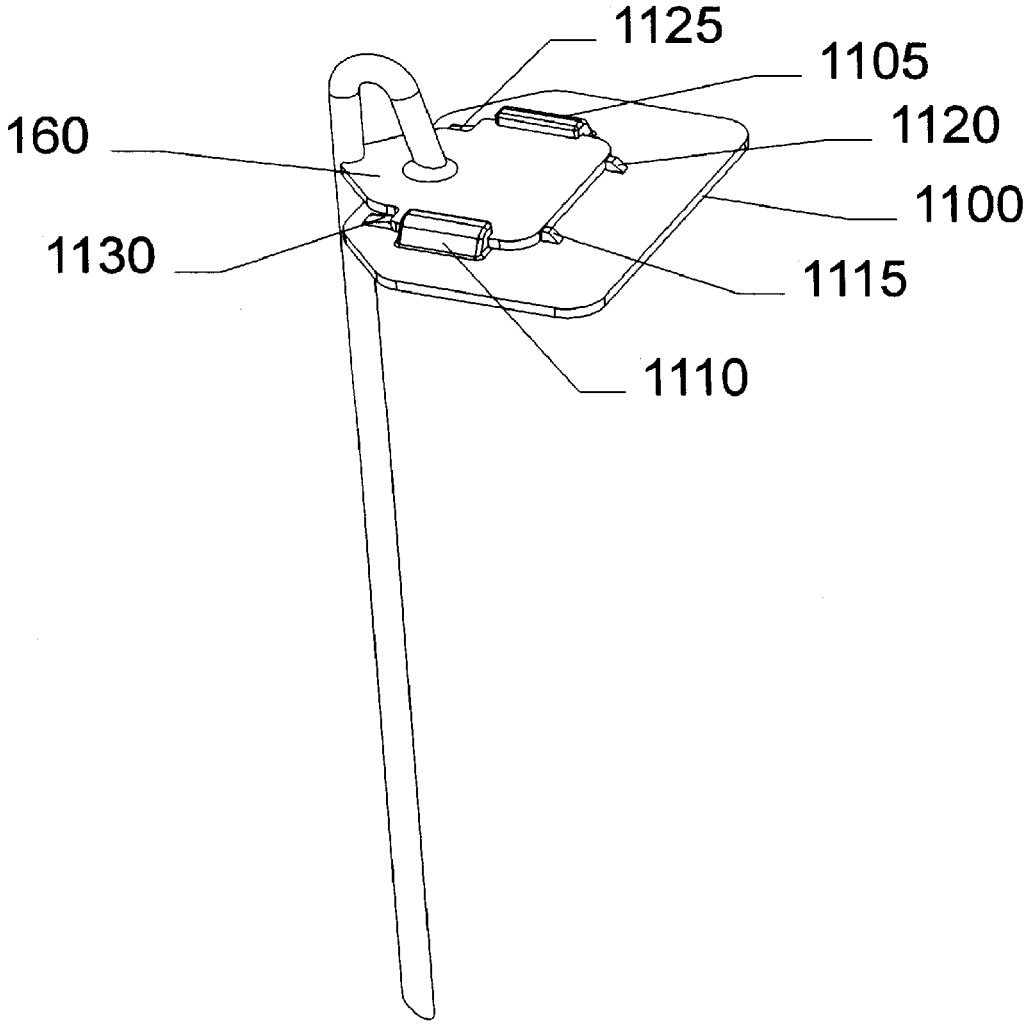
FIG. 12 shows a ninth seventh alternative embodiment, a steel straight 90 degree ground peg with an attachment plate.

In loose or friable soil a larger-than-normal compression plate will function better than a smaller one. A separate metal or plastic plate is attached to the existing, smaller plate. FIG. 11 shows such a plate 1100. Plate 1100 is attached under plate 160, as shown in FIG. 12 and in this application is 15 cm square, but can be larger or smaller as required.

Plate 1100 includes lugs 1105 and 1110, stops 1115, 1120, 1125, and 1130, and an optional notch 1135. Stops 1115 and 1120 normally project a small distance above the plane of plate 1100. Plate 1100 slidably mounts under plate 160 as shown in FIG. 12. When plate 160 is fully inserted into lugs 1105 and 1110, stops 1115 and 1120 prevent further engagement. Stops 1125 and 1130 are then forced upward, resting against the trailing edge of plate 160, thereby preventing any further movement of plate 1100 with respect to plate 160.

Notch 1135 permits insertion of plate 1100 past descending portion 135 (if present) of stake 100 (FIG. 1).

This embodiment provides improved stake performance, specifically of the stakes shown in FIGS. 1 and 2, in friable soil.

DESCRIPTION & OPERATION—10$^{TH}$ TO 12TH ALT. EMBODS.—FIGS. 13-15

Figure 13:
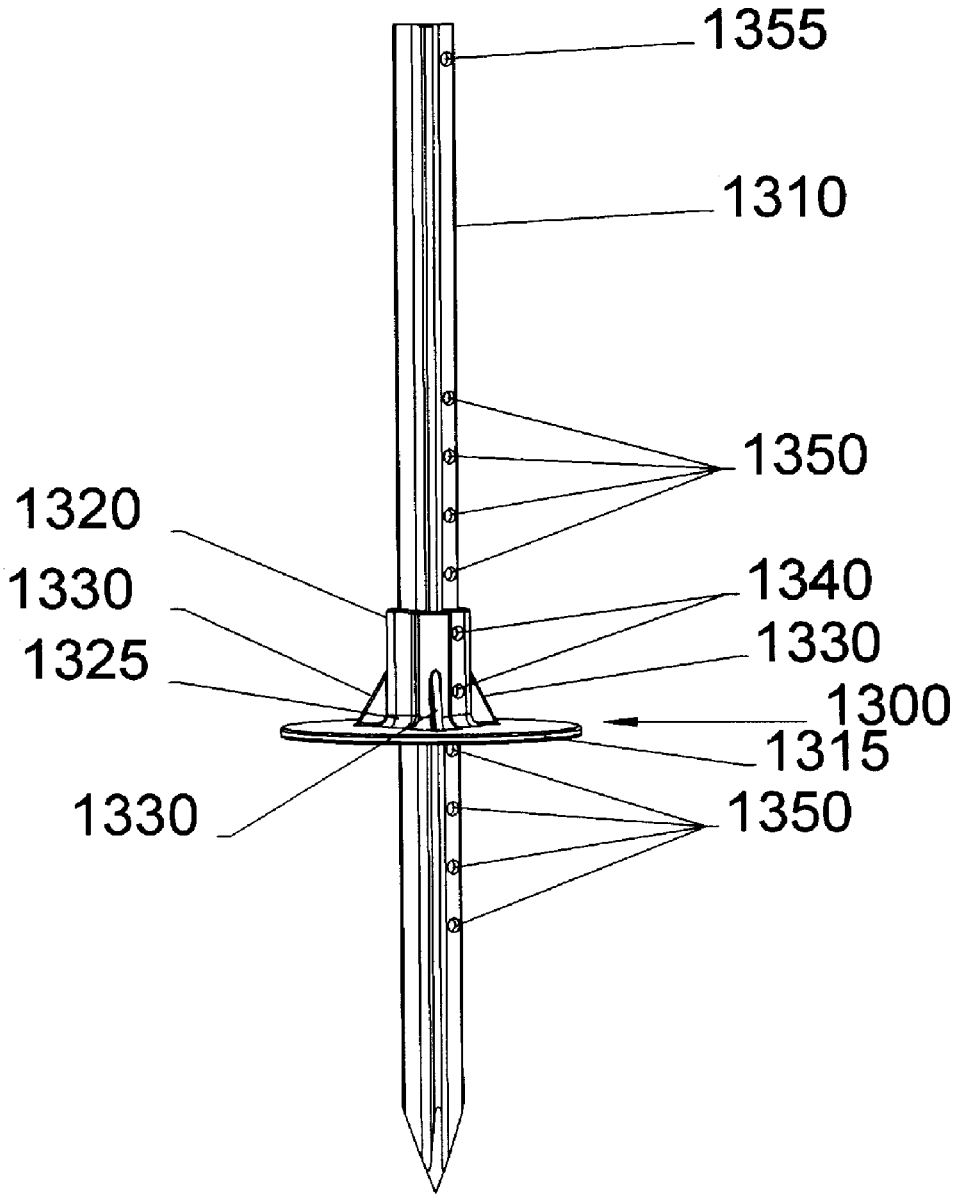
FIG. 13 shows a tenth alternative embodiment with an adjustable-height compression plate and a star-shaped spike or peg.
Figure 14:
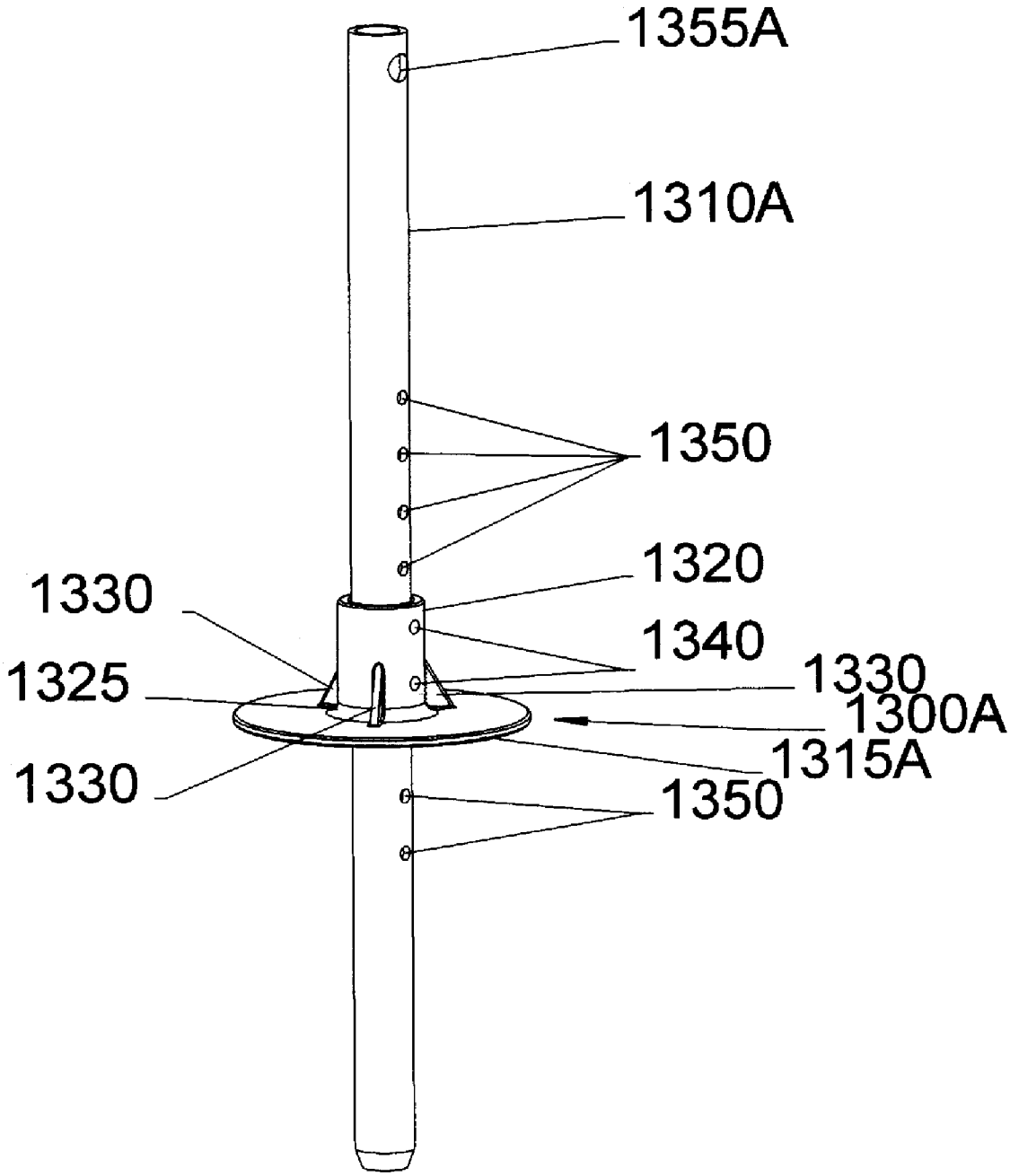
FIG. 14 shows an eleventh alternative embodiment which is similar to that of FIG. 13 but with a round spike or peg.
Figure 15:
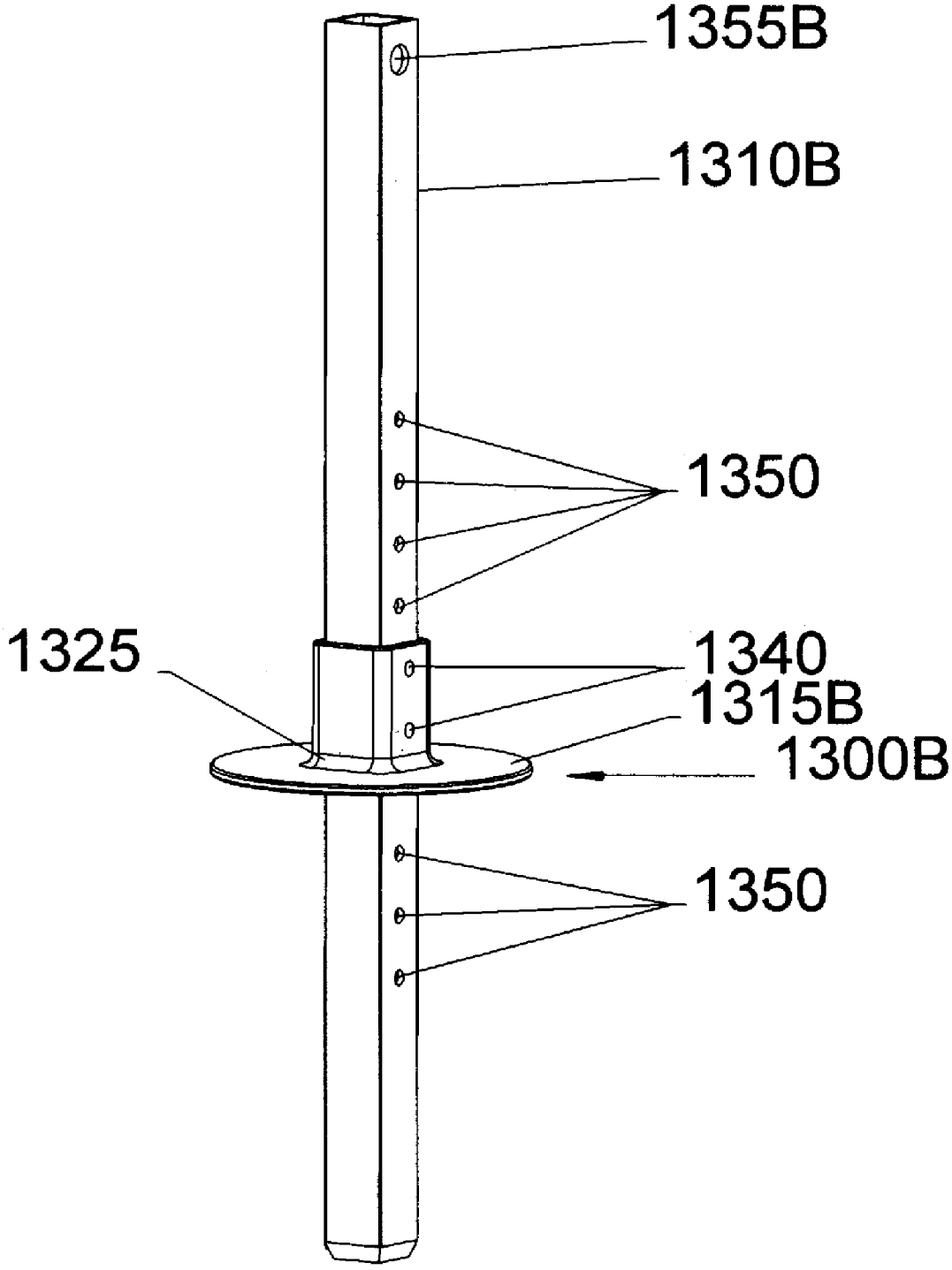
FIG. 15 shows a twelfth alternative embodiment which is similar to that of FIG. 14 but with a square spike or peg.

The above embodiments show compression plates fixedly attached to tines. Fixed attachment requires the tine to be driven into the ground a predetermined distance to seat the plate on the ground. FIGS. 13-15 show an adjustable-position support plate assembly 1300 that permits driving a stake 1310 variable distances into the ground (as necessary) before seating the plate on the ground.

Plate 1300 comprises a circular foot plate 1315, and a star-shaped, tubular support 1320. Support 1320 is secured to foot 1315 by welds, other attachments, or thickly cast regions 1325. This combined structure is strengthened by gussets 1330 which are attached to foot 1315 and support 1320.

The cross-section of stake 1310 is star-shaped, comprising three sections oriented at 120-degree increments about the axis.

Support 1320 incorporates one or more holes 1340. Stake 1310 also incorporates a plurality of holes 1350. If support 1320 contains two or more holes 1340, then their spacing optionally matches the spacing of holes 1350 on stake 1310.

Stake 1310 is first driven the desired distance into the ground (not shown). Then tubular support 1320 is made to engage stake 1310 and is slidably moved downward until the underside of foot 1315 rests on the ground. One or more holes 1340 are then aligned with one or more holes 1350. Finally, one or more bolts, pins, screws, cotter pins, dowel pins, clevis pins, etc. (not shown) are inserted through the aligned holes. Plate 1300 is thus rigidly secured to stake 1310.

A minor upward adjustment in the position of plate 1300 may be required if holes 1340 and 1350 are not aligned while foot 1315 rests on the ground. If so, the nearest holes can be pinned, and stake 1310 can later be driven a small distance farther into the ground.

The central openings of plates 1300A and 1300B in FIGS. 14 and 15, respectively, are circular and square, respectively, to accommodate stakes of circular and square cross-sections. Gussets 1330 are eliminated in FIG. 15.

Stakes 1310, 1310A, and 1310B optionally incorporate tie point holes 1355, 1355A, and 1355B, respectively. They can also include hooks (not shown), if required.

This embodiment features attachment collars for fitting to pickets to improve performance in sand, friable soil, or firm ground. It is used for temporary or permanent fencing and military purposes. The stakes are made of square timber, plastic, aluminum, steel, etc.

DESCRIPTION AND OPERATION—13$^{TH}$ & 14TH ALT. EMBODS—INC. SPRING—FIGS. 16-20

Figure 16:
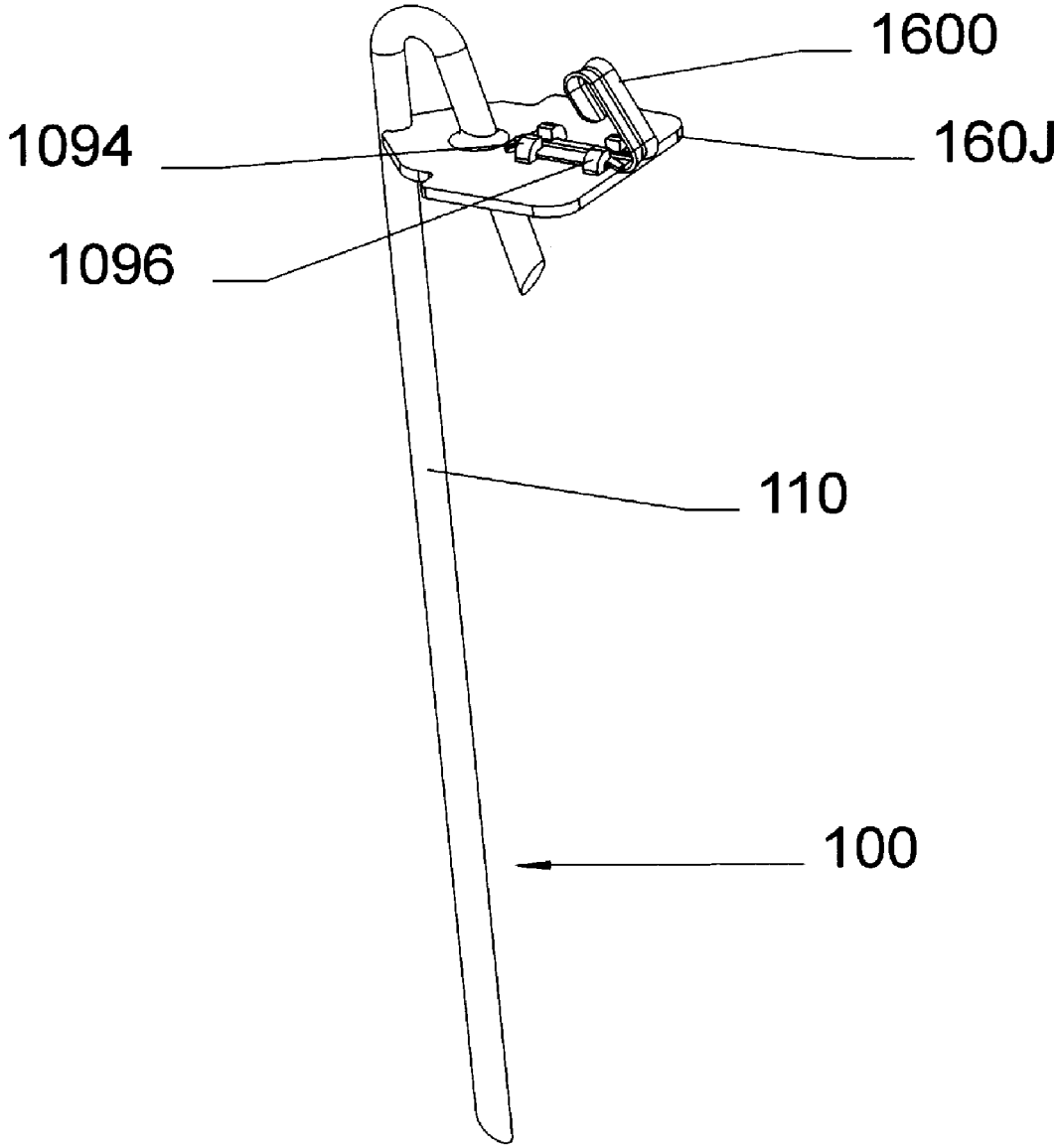
FIG. 16 shows a thirteenth embodiment: a steel straight 90° single ground peg with a spring attachment plate.
Figure 19:
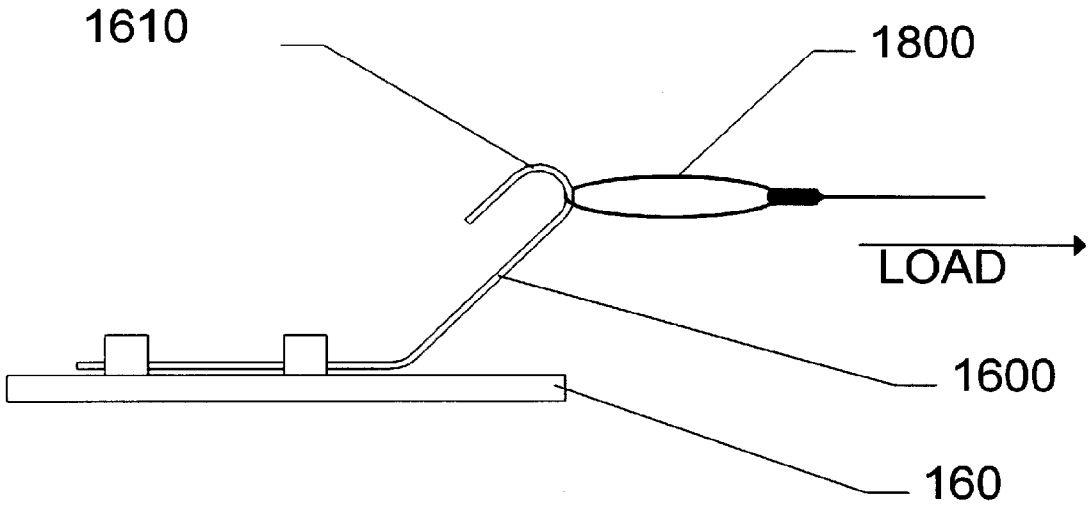
Figure 20:
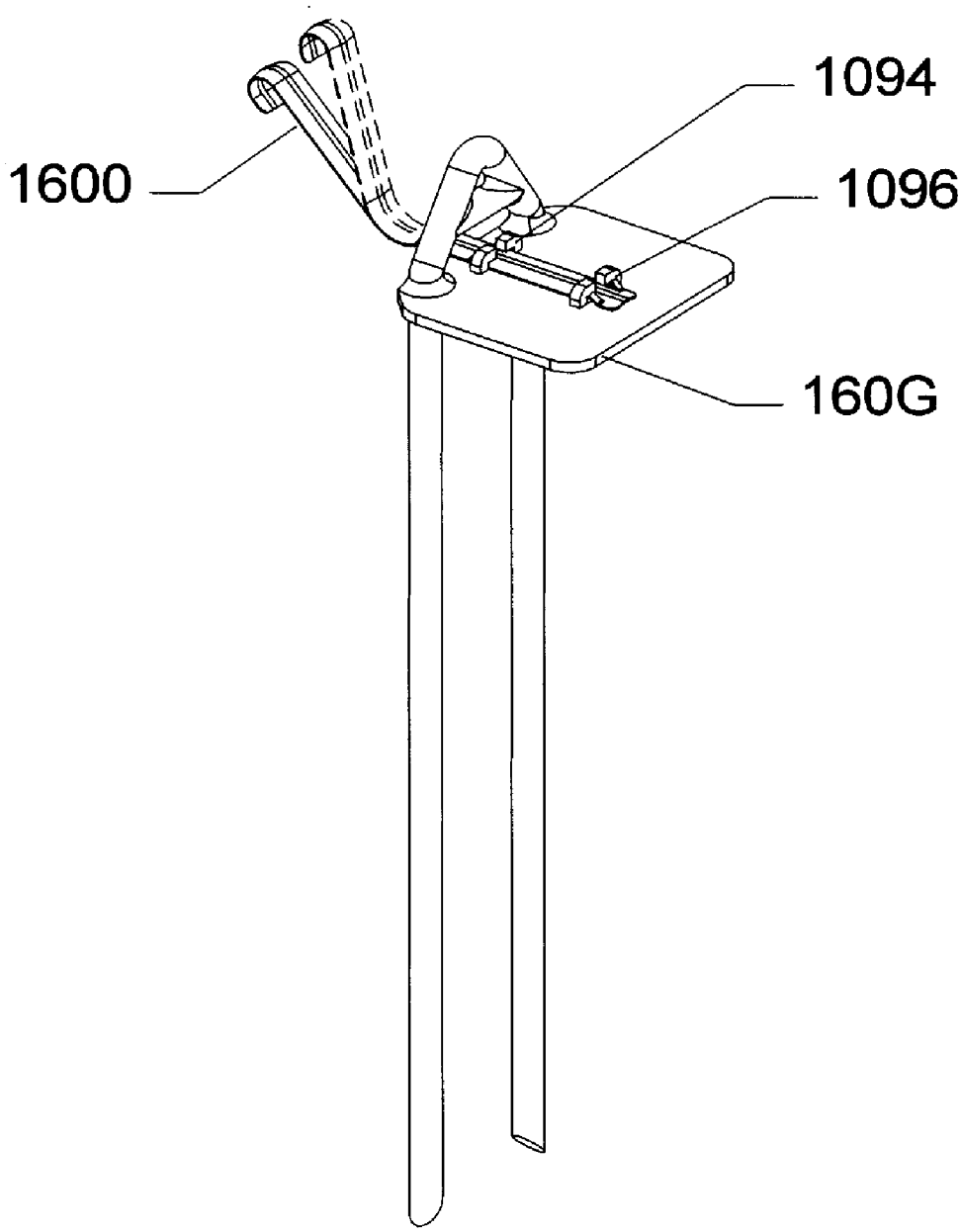
FIG. 20 shows a fourteenth embodiment: a steel straight 90° double ground peg with a spring plate.

FIG. 16 shows the embodiment of FIG. 1 with the addition of an optional spring 1600. Spring 1600 is used as a tie point. The flexibility of spring 1600 allows some resilience in the restraint of a tie-off rope (FIGS. 19 and 20). This resilience absorbs some energy from impulsive forces so as to decrease the likelihood of forcibly jerking and dislodging the stake, in this case stake 100, by the tie-off rope.

Figure 17:
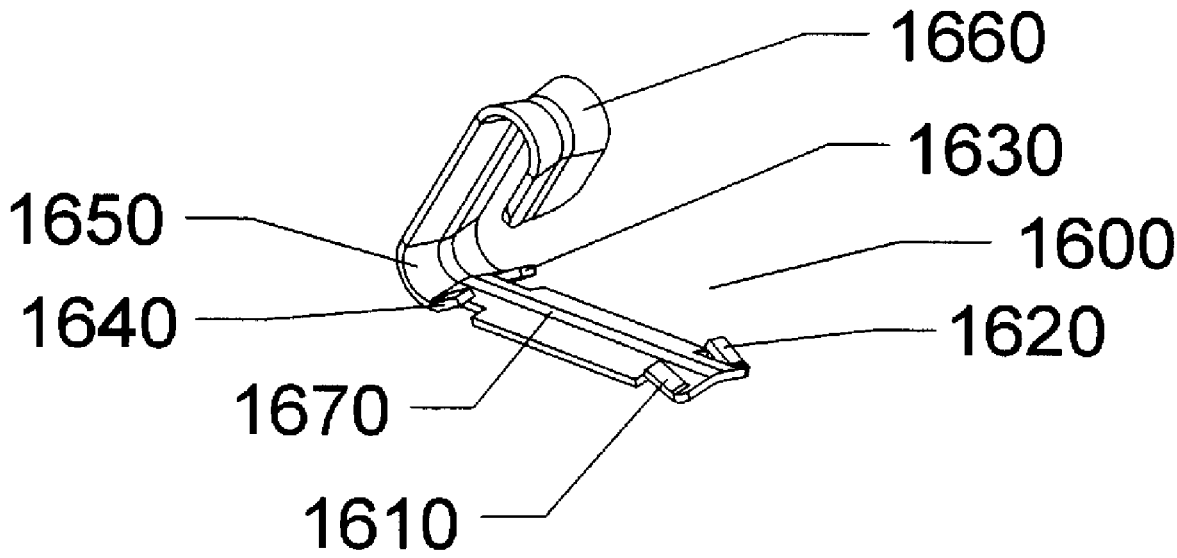
FIG. 17 shows a detail of the spring in FIG. 16.

Spring 1600 is shown in more detail in FIG. 17. In one embodiment it is between 2 and 4 cm in length, 1 cm in width, and made of spring steel. It includes fingers 1610, 1620, 1630, and 1640, a first bend 1650, and a second bend 1660, and a ridge 1670. Ridge 1670 increases the strength of spring 1600.

Spring 1600 is held in place by lugs 1094 and 1096 (FIG. 16) which are formed into plate 160J. Spring 1600 is inserted into plate 160J, first through lug 1096, then through lug 1094. Fingers 1610 and 1620 temporarily bend downward as they pass through lugs 1094 and 1096, then spring upward away from plate 160J after passing through lug 1096. In their upward positions, fingers 1610, 1620, 1630, and 1640 secure spring 1600 firmly between lugs 1094 and 1096.

Figure 18:
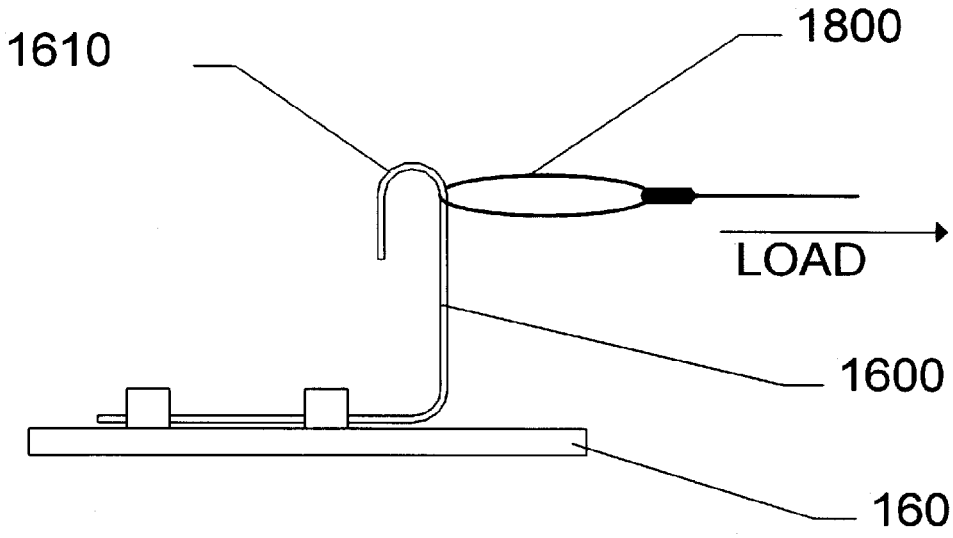
FIGS. 18 and 19 shows the spring of FIGS. 16 and 17 in use and partially extended.

Spring 1600 is shown in use in FIGS. 18 and 19. Guy or anchor rope 1800 loops around spring 1600 at bend 1610. When the load is relatively small, spring 1600 applies a restraining force which keeps rope 1800 at the first position shown in FIG. 18. When the load is larger, spring 1600 extends and allows rope 1800 to travel a small distance to the second position shown in FIG. 19. Rope 1800 is prevented from moving beyond the second position, however. This resilience in restraint of rope 1800 absorbs some energy when the rope is pulled abruptly to prevent impulsive forces from dislodging stake 100.

FIG. 20 shows an alternative mounting of a similar spring 1600'. In this case, hook 17 is eliminated from the anchor of FIG. 10. Spring 1600' is secured to by lugs 1094 and 1096. Spring 1600' is slightly longer than spring 1600 (FIGS. 16-19). When in tension, as shown in the broken lines, spring 1600' causes plate to be forced against the ground, providing a secure anchor.

This embodiment includes a spring and in one application is used for securing modern, lightweight tents. It reduces guy-rope shock to the tent and stake in windy conditions. It can also be used to secure heavier and more vertical loads such as annex walls, and large canvas tents.

DESCRIPTION—THREE-PRONGED (15TH) EMBODIMENT—FIGS. 21,22,23

Figure 21:
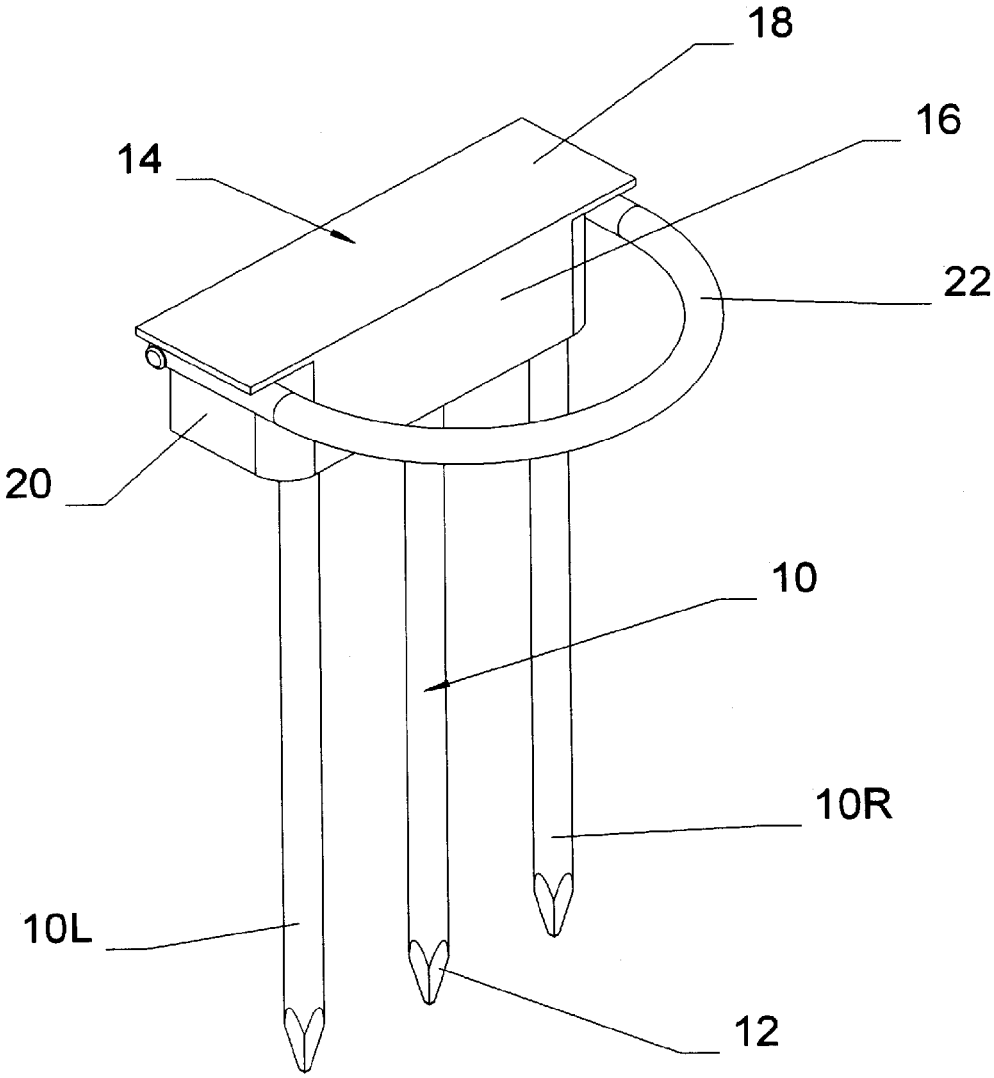
FIG. 21 shows a fifteenth embodiment: a three-prong mooring anchor with a tie loop.
Figure 22:
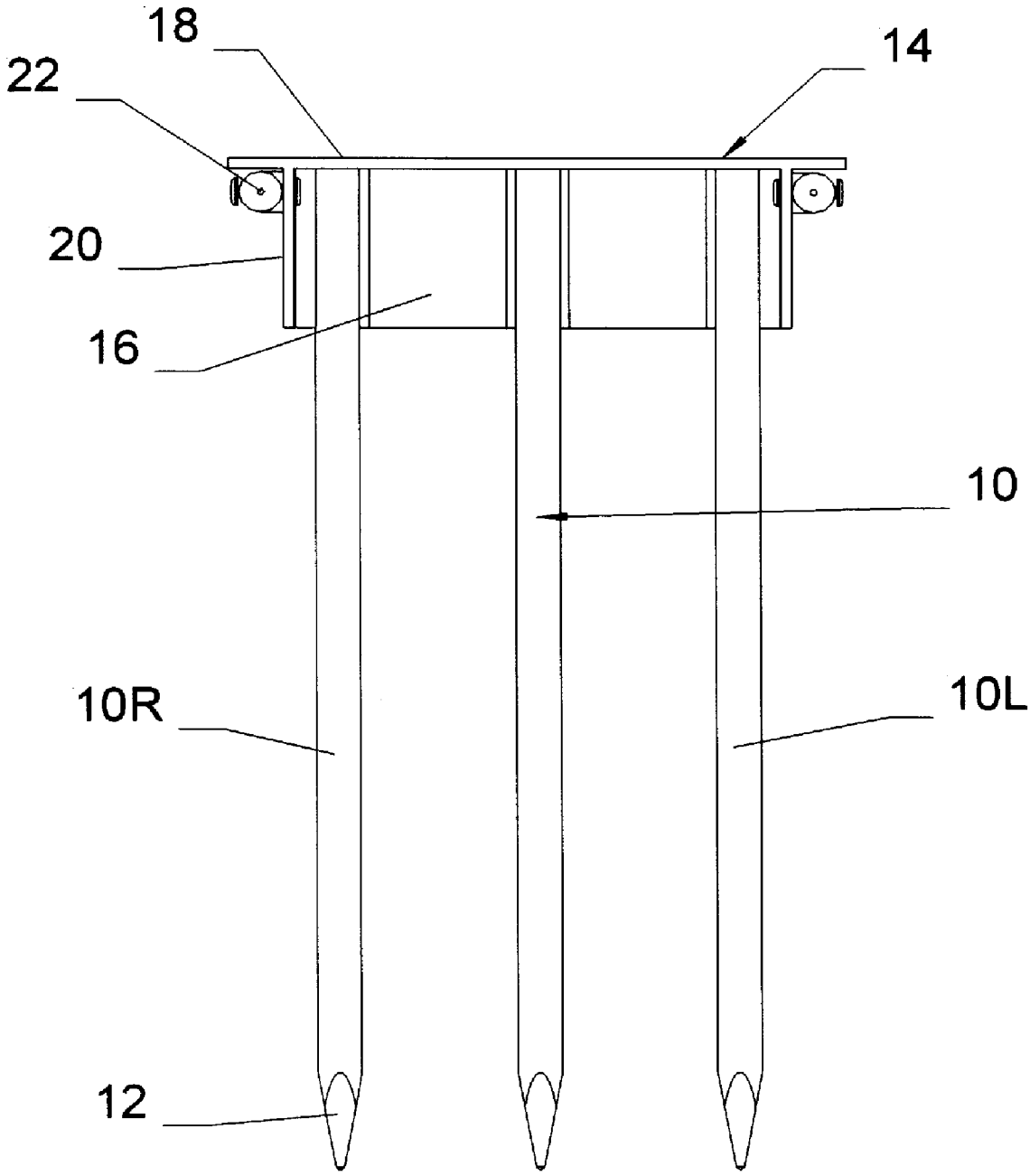
FIG. 22 shows an inverted rear view of the anchor of FIG. 21.
Figure 23:
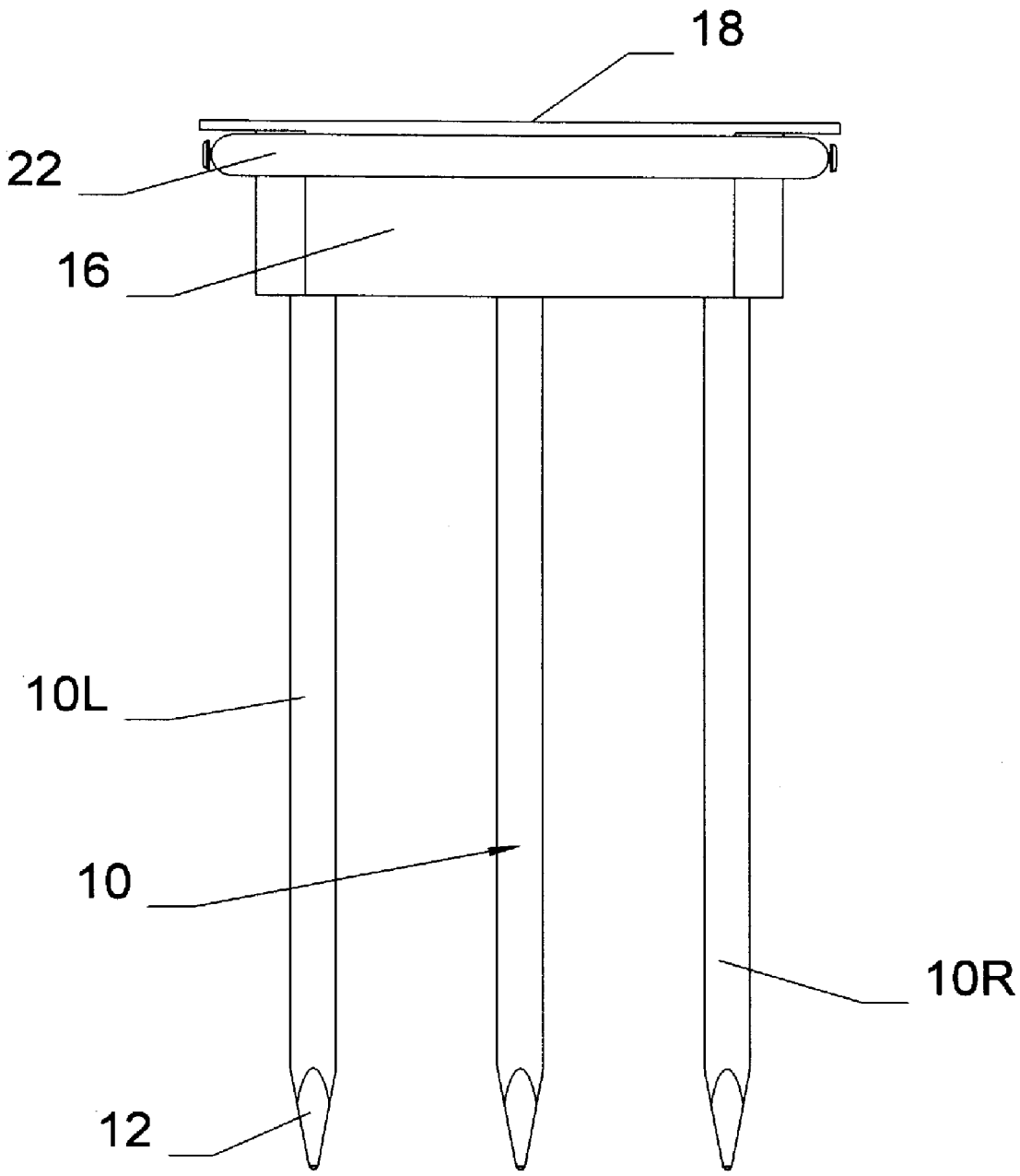
FIG. 23 shows a front elevation of the anchor of FIG. 21.
Figure 27:
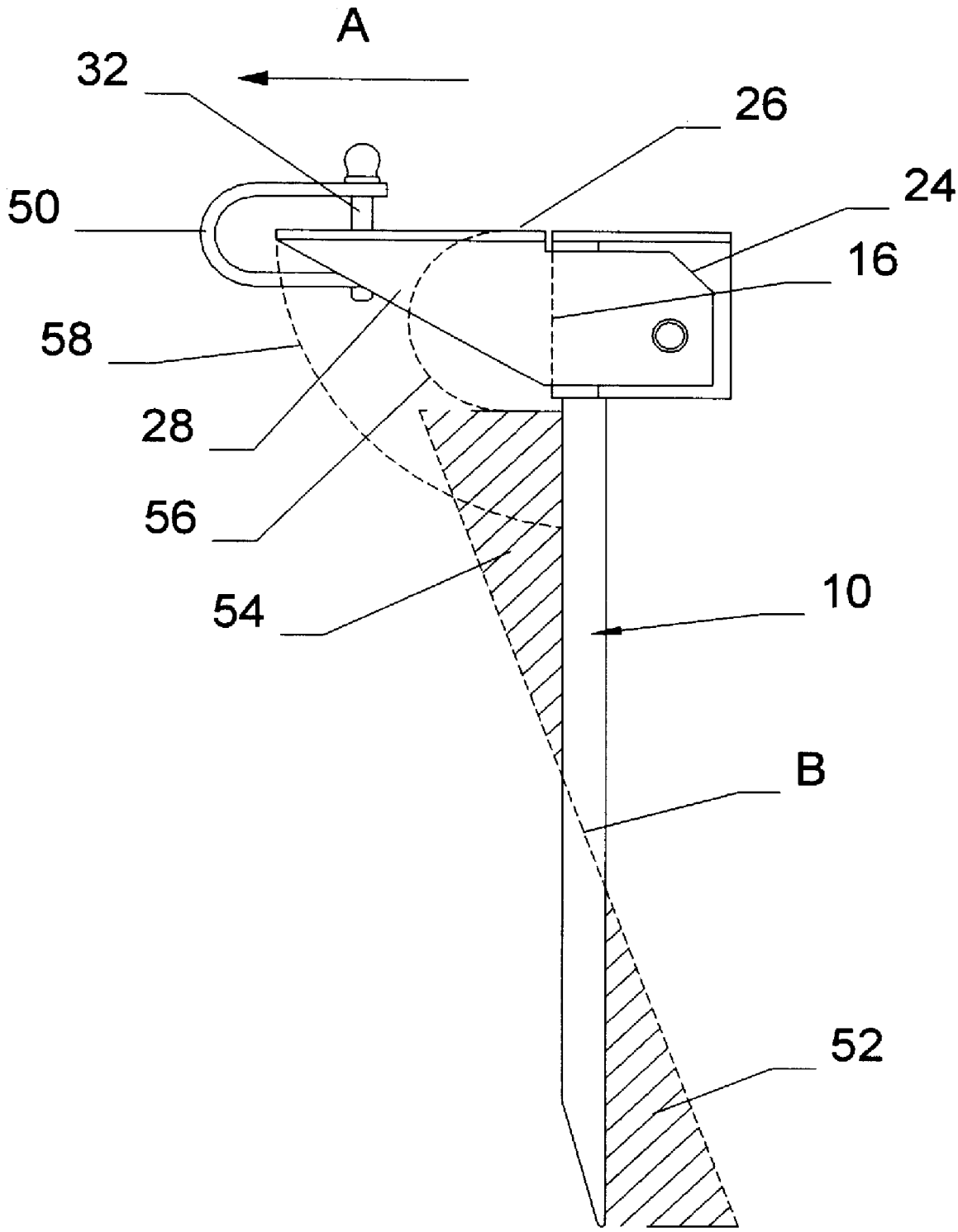
FIG. 27 shows a schematic side elevation of the anchor of FIG. 24, illustrating a mode of operation.

FIGS. 21, 22, and 23 show one embodiment of a ground anchor comprising three parallel rod-like tines, rods, or spikes 10, tapered, pointed, or sharpened at their lower ends 12 and supported in spaced relationship by an upper mounting member 14. Member 14 is generally L or angularly shaped and has two flat parts, a front or vertical plate 16 and top or horizontal plate 18. Front plate 16 is parallel to tines 10 and functions in use as a compression member because it compresses the sand or soil. Plate 16 has opposite free ends 20 that extend rearwardly below top plate 18 at a roughly 90 degree angle to top and front plates 18 and 16. Ends 18 pivotally support a stabilizing member 22 in the form of an arcuate loop or hoop. Top plate 18 has extending ends or wings that serve as stops to prevent loop 20 from pivoting up beyond horizontal or beyond perpendicular to tines 10 when loop 20 is extended horizontally as shown in FIG. 21. Loop 20 also provides a means for attachment of a hawser (not shown) by means of a shackle or the like (FIG. 27).

Returning to FIG. 21, mounting member 14 (including compression plate 16 and the free ends of top plate 18) are formed as an integral body from a length of angle-section aluminum or stainless steel, about 2 to 2.5 mm thick.

All three tines 10 are welded (FIG. 22) to the inner face or rear side of compression plate 16 and outer tines 10R and 10L are also welded to free ends 18.

Typically, tines 10 are made of 8 mm to 12 mm circular or elliptical cross-section rod and may be from 200 mm to 750 mm long. In practice I have found for ground anchoring that an optimum tine length of about 250 mm to 300 mm provides adequate anchoring power combined with ease of stowage, and ease of insertion and retraction. Below about 200 mm in length, the ground anchor does not provide secure anchoring power. While anchoring power is increased for tines over about 300 mm, this exceeds the anchoring required for shore anchoring of vessels, adds to inconvenience in stowage and handling, as well as increased difficulty in insertion and withdrawal from sand or soil.

DESCRIPTION—16TH EMBODIMENT—FIGS. 24-27

Figure 24:
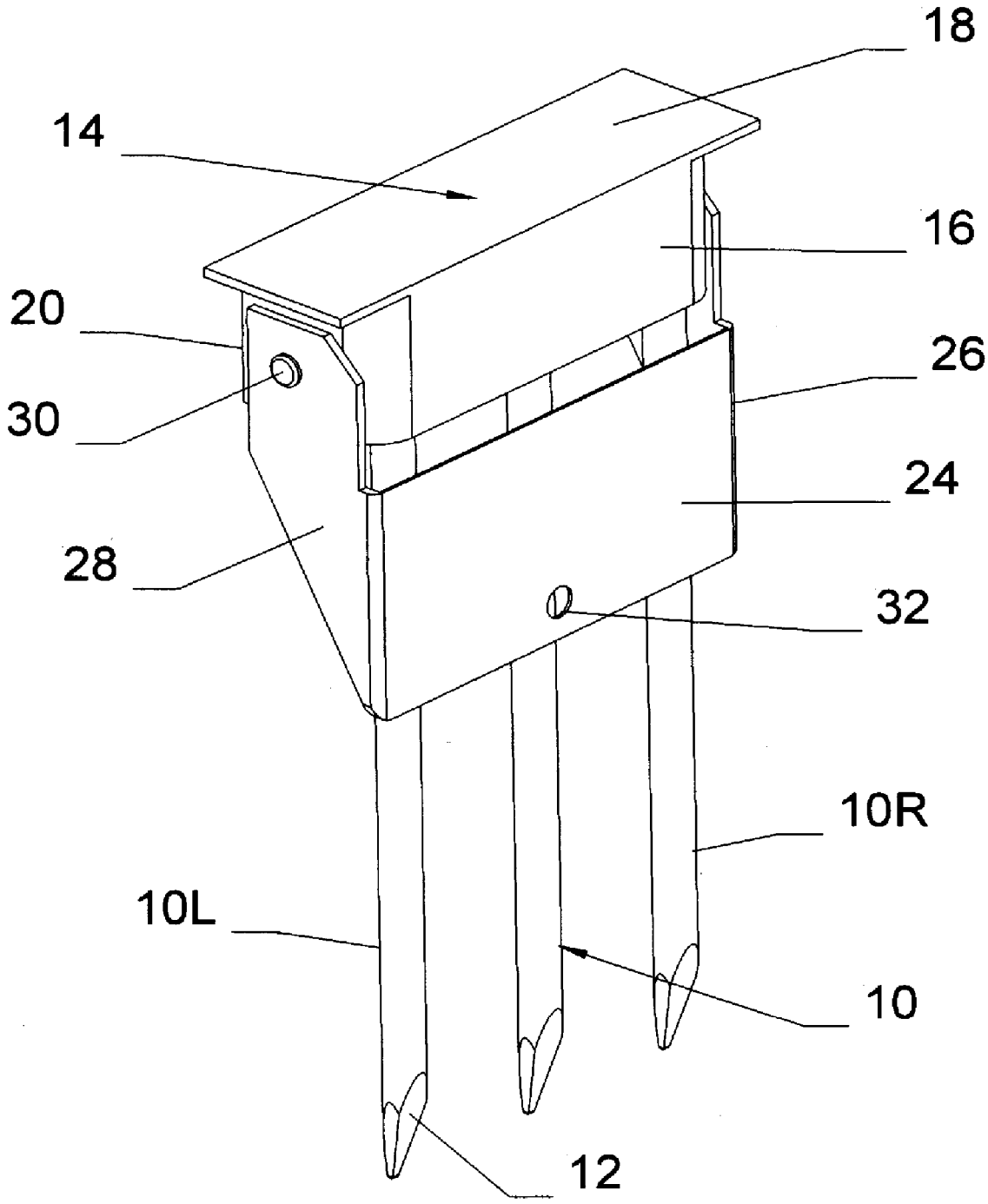
FIG. 24 shows a sixteenth embodiment: an anchor with a compression plate in a retracted position.
Figure 25:
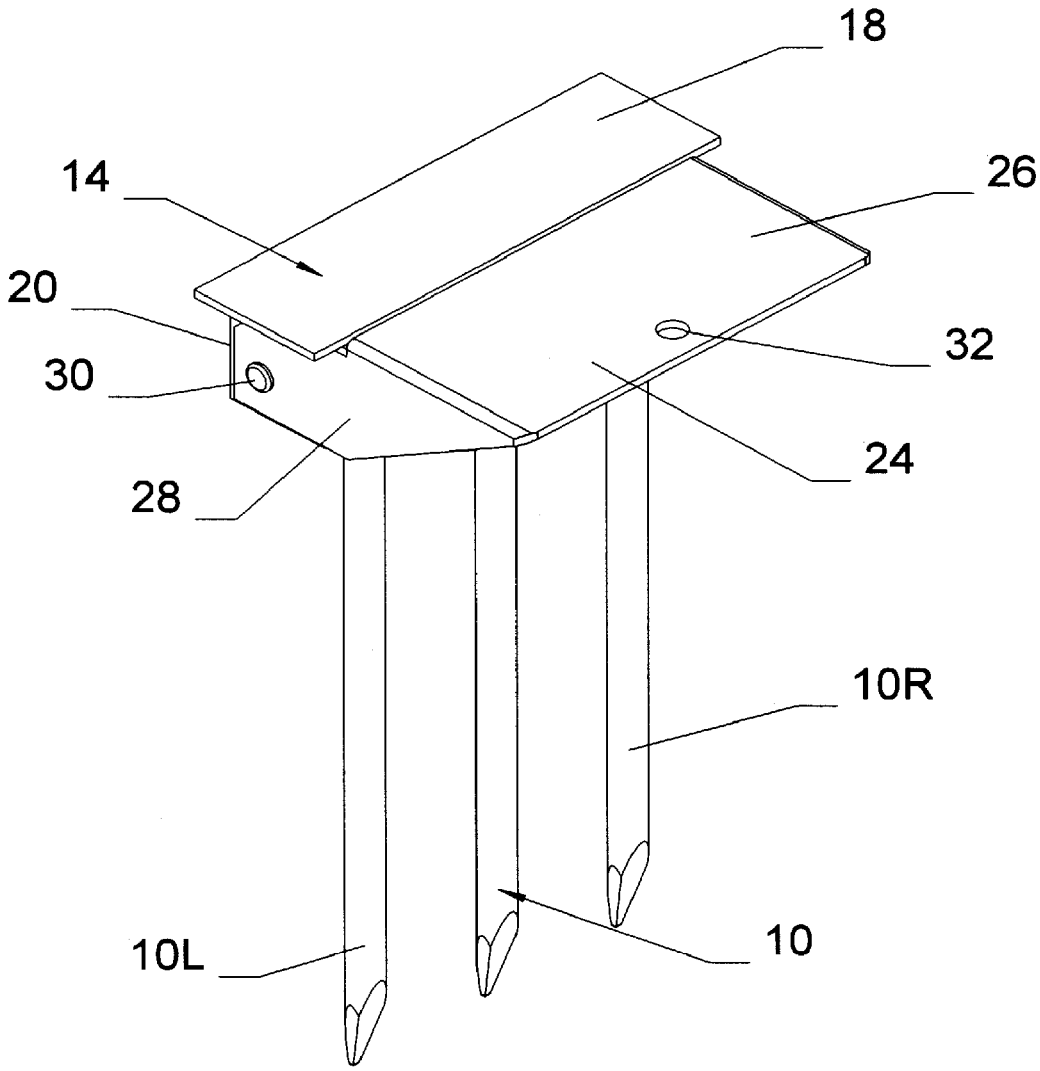
FIG. 25 shows the anchor of FIG. 24 with the compression plate in an extended position.
Figure 26:
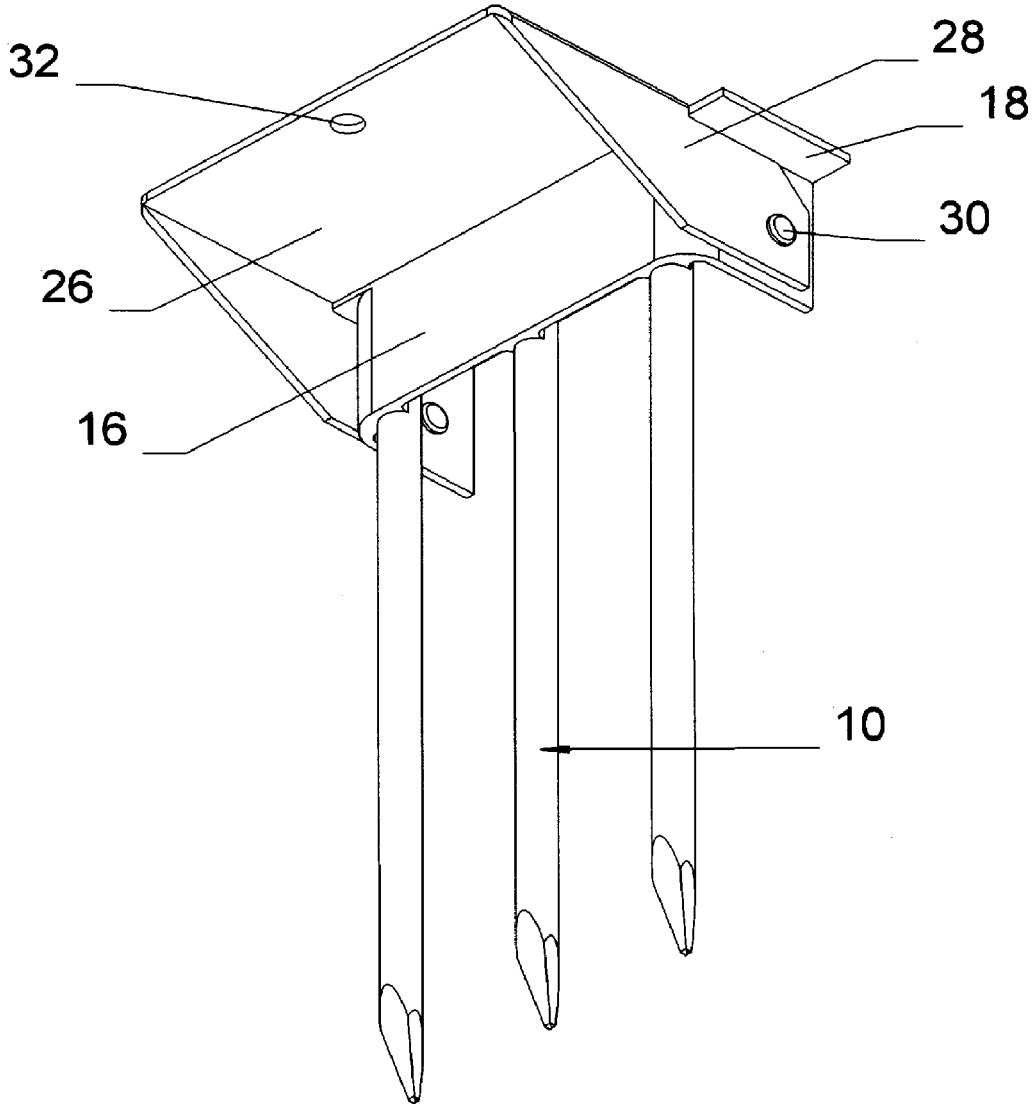
FIG. 26 shows a perspective view of the anchor of FIG. 24 from below.

FIGS. 24 to 26 show a sixteenth alternative embodiment of the anchor. The main difference over the embodiment of FIGS. 21 to 23 is the configuration of the stabilizing member. The lower ends of tines 10' are tapered to a blunt tip. A horizontal stabilizing member 24 comprises a rectangular plate 26 with planar side plates or free ends 28 extending perpendicularly from the respective sides of plate 26. Free ends 28 are pivotally attached to sides 20 of mounting member 14. Plate 26 is parallel to the plane of tines 10. Stabilizing member 24 can be made from a single piece of rigid material such as steel or aluminum, cut into the appropriate shape, and bent to form plate 26 and its free ends 28.

Each free end 28 is generally rectangular, and its long or vertical dimension is greater than its horizontal dimension and is also longer than the vertical dimension of plate 26. The horizontal dimension of each end 28 is about one-quarter the length of the long dimension of plate 26. A long side of each end 28 is coincident with a short side of plate 26. The bottom edge of each end 28 is angled upwardly from front to rear, with the bottom corners of plate 26 being coincident with the front bottom corners of a respective end 28. The top front corner of each end 28 is also angled upwardly from front to rear and each end is pivotally attached to an end 20 of member 14.

Like stabilizing member or loop 22 of FIGS. 21 to 23, stabilizing member 24 of FIGS. 24 to 26 is able to pivot by means of rivets or pins 30 or the like. Each rivet extends through an end 28 and an end 20. Member 24 can pivot from a retracted, folded, or storage position (FIG. 24) in which plate 26 is vertical and parallel to the plane of tines 10, to an extended or in-use horizontal position (FIG. 25) in which plate 26 is substantially perpendicular to tines 10.

Plate 26 has an aperture 32 to permit attachment of a hawser by means of a shackle or the like (not shown.)

FIG. 26 shows further detail from below of the tines, mounting member, and pivotal stabilizing plate.

Figure 28A:
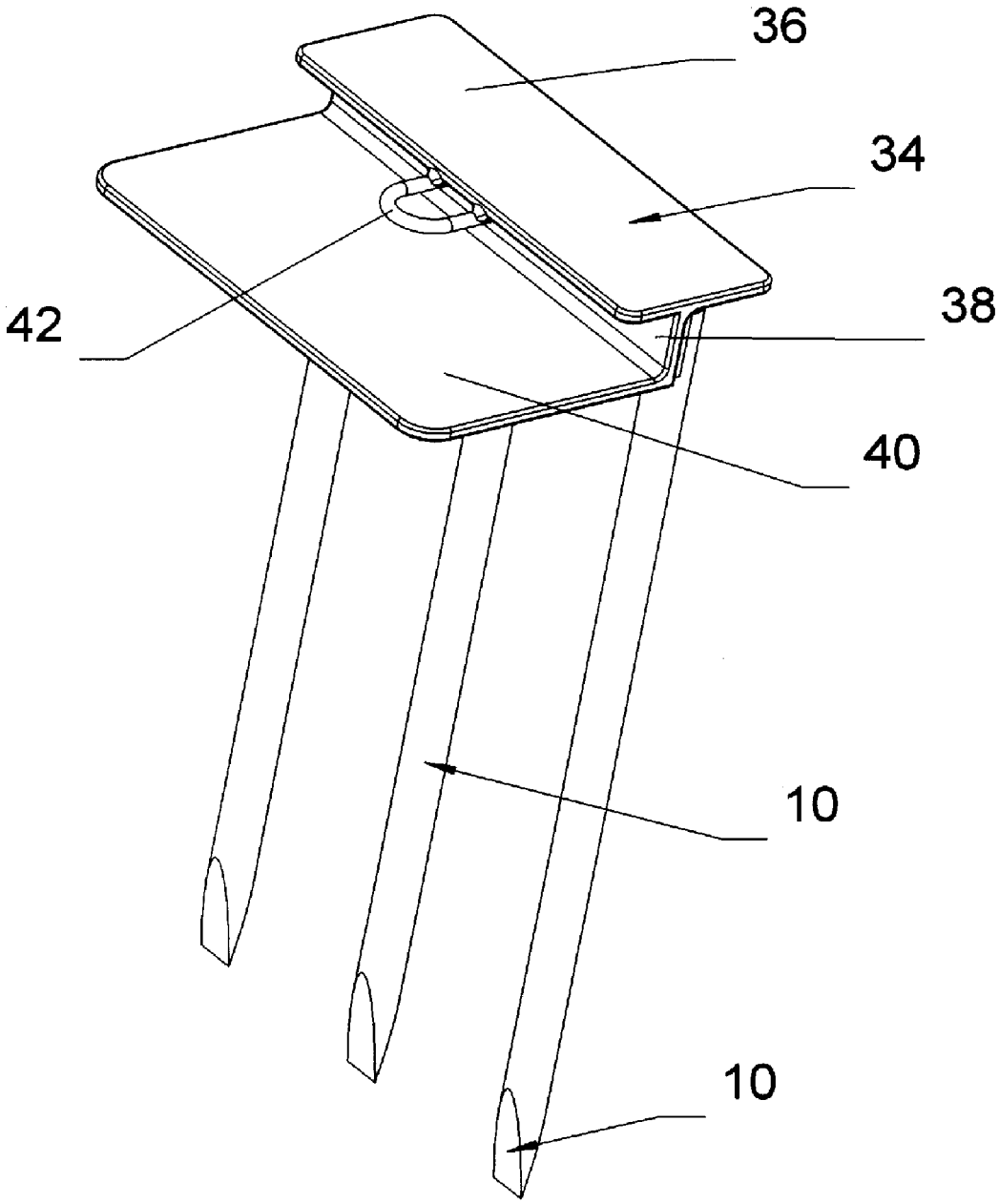
FIG. 28(*a*) shows a seventeenth embodiment: an anchor with three tines and tie loop attached above the compression plate.
Figure 28B:
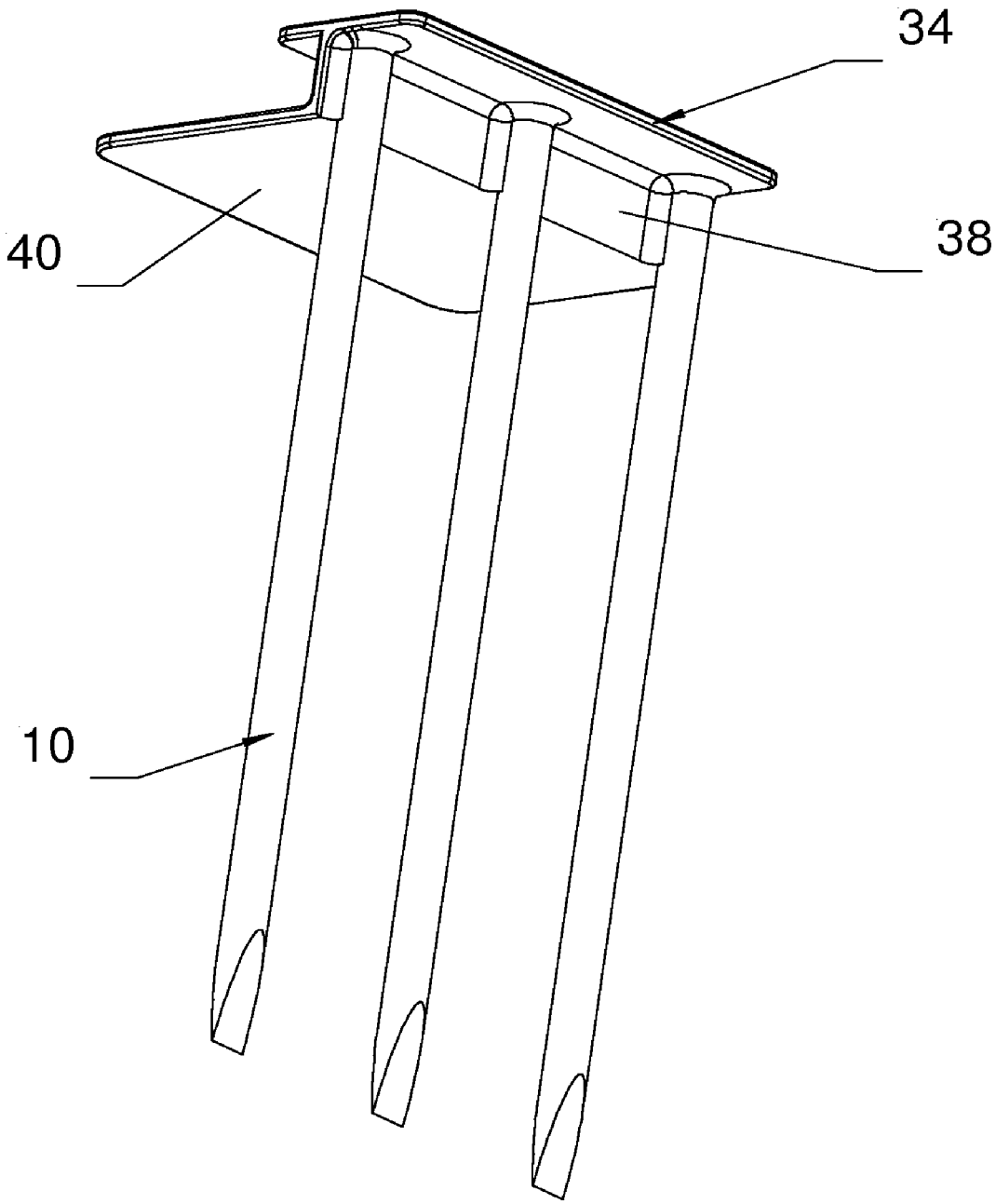

DESCRIPTION—17TH EMBODIMENTS—FIGS. 28(*a*), 28(*b*), AND 29

Ignoring FIG. 27 temporarily, FIGS. 28(*a*), 28(*b*), and 29 illustrate another embodiment of the anchor. In FIGS. 28(*a*) and 28(*b*), the compression member of the previous figures is absent. A mounting member 34 includes a top horizontal plate 36, an integral vertical connecting member 38, and an integral fixed horizontal stabilizing member 40. Both stabilizing member 40 and connecting member 38 are rectangular, with long sides the same length as those of top plate 36. The short sides of stabilizing member 40 are only slightly shorter than the long sides, with the short sides of connecting member 38 being about one-sixth of the length of its long sides. Connecting plate 38 is attached perpendicularly to plate 36 along the center of its long axis and to stabilizing member 40 along its back long edge.

Figure 29:
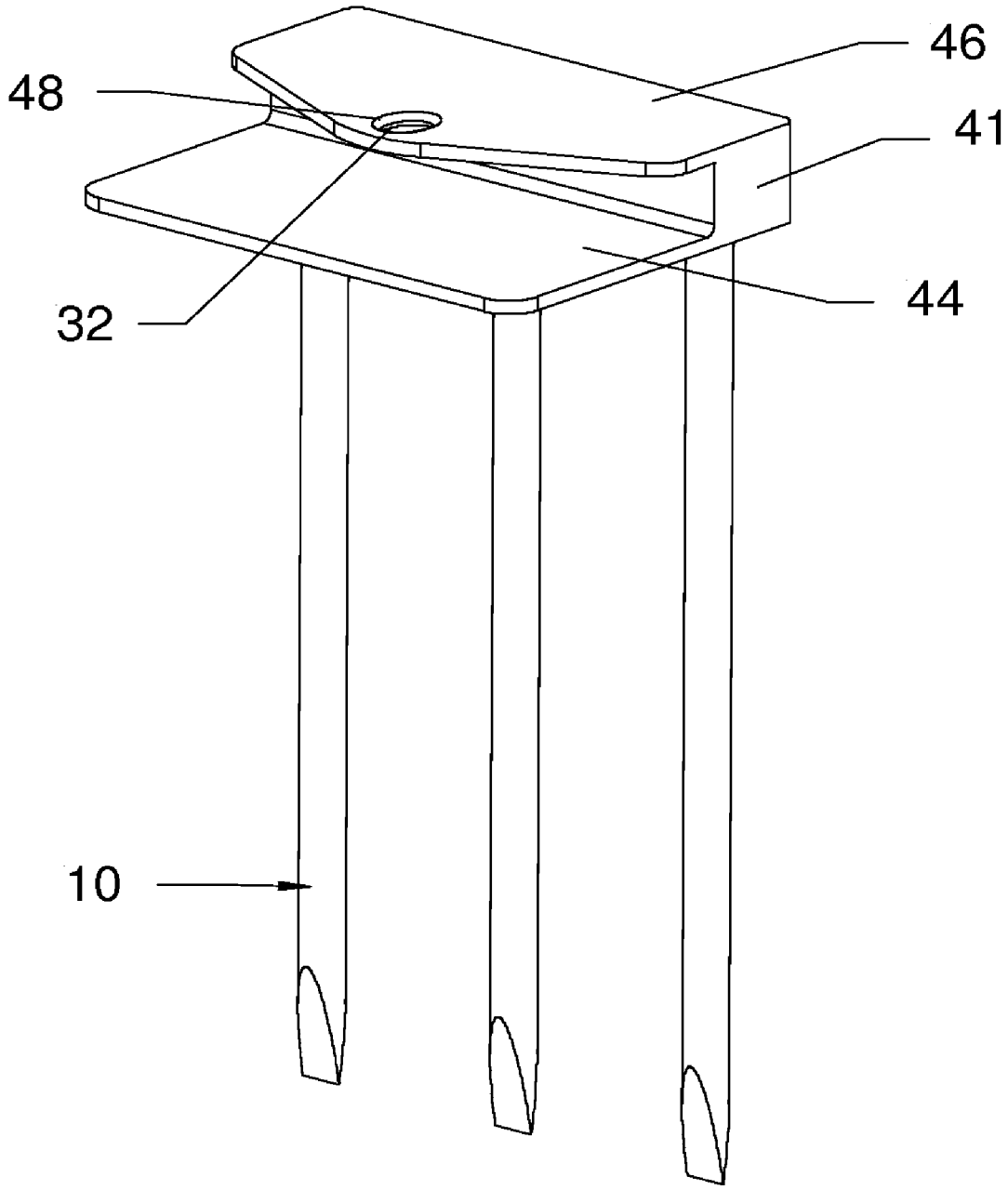
FIG. 29 shows an eighteenth embodiment similar to the anchor of FIG. 28*a* with a tie hole in an upper plate.

A loop 42 is analogous in function to aperture 32 of FIGS. 24 to 26 and is attached to top 36, allowing a hawser (not shown) to be attached to the anchor, The lower tips of tines 10 may terminate in a flat blade 10" or as a blunt point, as shown in FIG. 29.

As illustrated in the bottom perspective view of FIG. 28(*b*), tines 10 are attached by welds to top 34 and to connecting plate 38. This treatment is well-suited to construction of ground anchors out of metal in which tines 10 are to be welded to an integral top. Alternatively the anchor can be manufactured by forging and plastic molding, or a combination of metal and plastics.

FIG. 29 shows another embodiment similar to that of FIG. 28, except as follows: Two vertical connecting rectangular side plates 41 connect a fixed, rectangular, lower horizontal plate or stabilizing member 44 to a top horizontal plate or stabilizing plate 46. Side plates 41 thus join the side edges of plates 44 and 46. Top 46 is generally rectangular except for its front side, which extends to a symmetrical angular termination or point 48 pointing to the boat (not shown) and parallel to member 44. Tines 10 are parallel to sides 41 and are attached to the bottom of top 46. The hawser (not shown) is attached to aperture or hole 32 adjacent termination 48 in top 46.

The length or height of each of sides 41 the same as the length of connecting member 38 and its width is about the same as its height.

The structure of FIG. 29 is made by bending and welding sheet metal (welds not shown) In FIGS. 28(*a*), 28(*b*), and 29, stabilizing member 40 is perpendicular to the plane of the tines.

Operation—FIG. 27

While not wishing to be bound by any particular theory or hypothesis, I will now describe the mode of operation the anchor as presently understood with reference to FIG. 27, which depicts the operation of the embodiment of FIGS. 25 and 26. This mode of operation also applies to the other embodiments, with slight modifications, as discussed below.

In use, the ground anchors are placed at a distance from the water's edge and thus by nature, the tension applied in the hawser is generally parallel to the ground in the region of the anchor.

Assume that a boat (not shown) sails close to the shore and the captain desires to moor the boat to the shore, which may be a sand beach or soil. After selecting a region of the shore within which to anchor the vessel and after setting a bow anchor in the water, the captain or a mate wishing to set a stern line to anchor the vessel to shore sweeps aside a top layer if it is very loose sand (not shown), typically about 25 mm in depth. Then they insert the anchor (with stabilizing member 24 horizontal as shown in FIG. 26) into the sand with tines 10 normal to the ground surface, using hand or foot pressure applied to the top of mounting member 14. They insert the anchor to the fullest extent so that tines 10, compression member 16, and plate free ends 28 are embedded in the sand and plate 26 lies against the surface of the sand.

When tension is applied in the direction shown by arrow A to a shackle 50, installed in aperture 32, from the anchor line or hawser (not shown) by tugging from the vessel, tines 10 initially undergo a degree of bending (not shown) about a fulcrum point B, about two-thirds of the way along the length of the tines. That is, the anchor experiences rotational forces around point B. This rotational force induces compression in lower and rear region 52 and upper and front region 54 in the sand adjacent the tines. Regions 52 and 54 are shown shaded at the lower rear and the upper front of tines 10, respectively. At the same time, compression member 16 (FIGS. 26 and 27) exerts a roughly horizontal force, causing the sand in small top compression region 56, shown by a dashed line, to become compressed.

As tines 10 undergo a limited degree of bending, plate 26 also induces a downwardly-directed force, tending to compress the underlying large top compression region of sand 58, also outlined in dashed lines. Region 58 overlaps region 56 and the upper part of compression region 54, thus reinforcing the sand mass against a rotational force applied to the anchor. The tugging tension is periodically released (e.g., by the shoreward portion of wave cycles releasing or reversing force on the vessel). When this occurs, the resilience of tines 10 returns the anchor to a rest or static position. I believe that the downwardly extending free ends 28 of member 24 contain and stabilize the sand in regions 56 and 58. In the absence of stabilizing ends 28, some lateral displacement of sand will occur, tending to lower the compression and holding ability of the anchor.

To summarize, as tension increases in the direction of arrow A, plate 26 presses with increasing force against the sand surface. The superior holding power of this design is achieved by the combination of this downward compression and the secure anchoring effected by the several and long tines 10 which are constrained in their positions by the mass of soil behind their lower ends and in front of their upper ends.

For anchoring larger vessels, or anchoring in adverse conditions where greater anchoring strength is required, two ground anchors may be placed into the ground, one a short distance directly behind the other along a line in the direction of applied tension. When connected by a single line, for example, in the configuration of a long loop, two anchors thus arranged can provide greater resistance to the rotational forces created by hawser tension which might otherwise cause a single anchor to dislodge from the ground.

Although the foregoing discussion has been in terms of FIG. 27, which is a schematic of the embodiment shown in FIG. 24 to 26, a similar theory of operation applies to the embodiment of FIGS. 21 to 23, except that compression region 58 will have less compression. In this embodiment, a user inserts the anchor in the ground by applying downward force to top plate 18.

Likewise, a similar theory of operation is applicable to the embodiments shown in FIGS. 28(*a*), 28(*b*), and 29, these two embodiments being essentially isomorphic to one another with respect to the distribution of compression induced on the sand when tension is applied by the hawser. In either of these embodiments, regions of compression 56 and 58 will be formed adjacent the tines. Analogously, fixed stabilizing member 40 takes the role of plate 26 of the embodiment of FIGS. 24 to 26, inducing compression region 58, by the rotational force exerted by the tension applied by the hawser. However, the absence of a vertical compression member 16 indicates that region 56 is not compressed separately from region 58 in either of the embodiments in FIGS. 25 and 26 the anchor need not be inserted into the ground beyond the depth in which fixed stabilizing member 40 is in contact with the sand surface. The user can insert the anchor into the sand or soil conveniently by applying downward force with their hands or foot to top plate 36.

DESCRIPTION—19TH EMBODIMENT—FIG. 30

Figure 30:
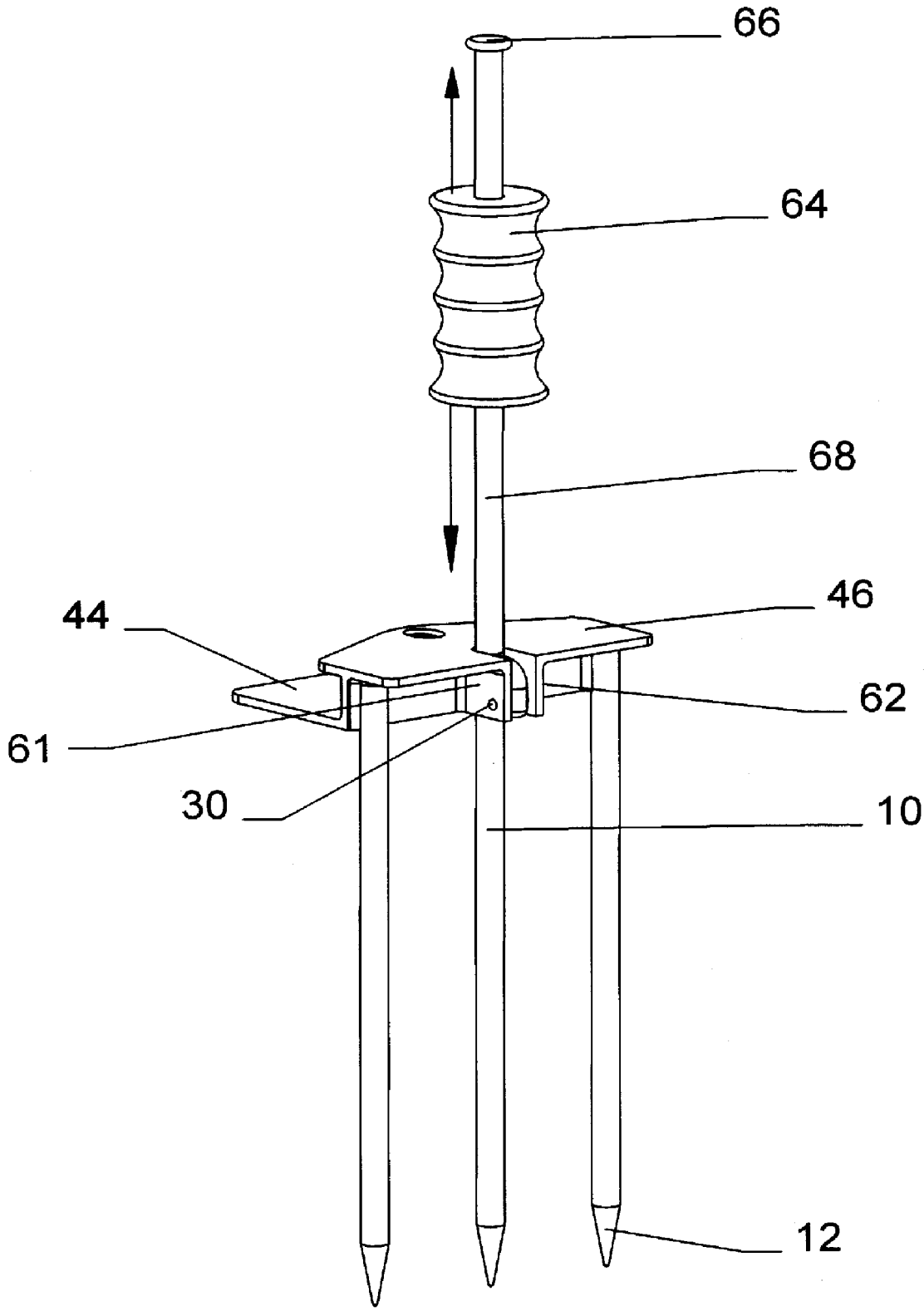
FIG. 30 shows a nineteenth embodiment: an anchor with three tines and a hammer sleeve.
Figure 31:
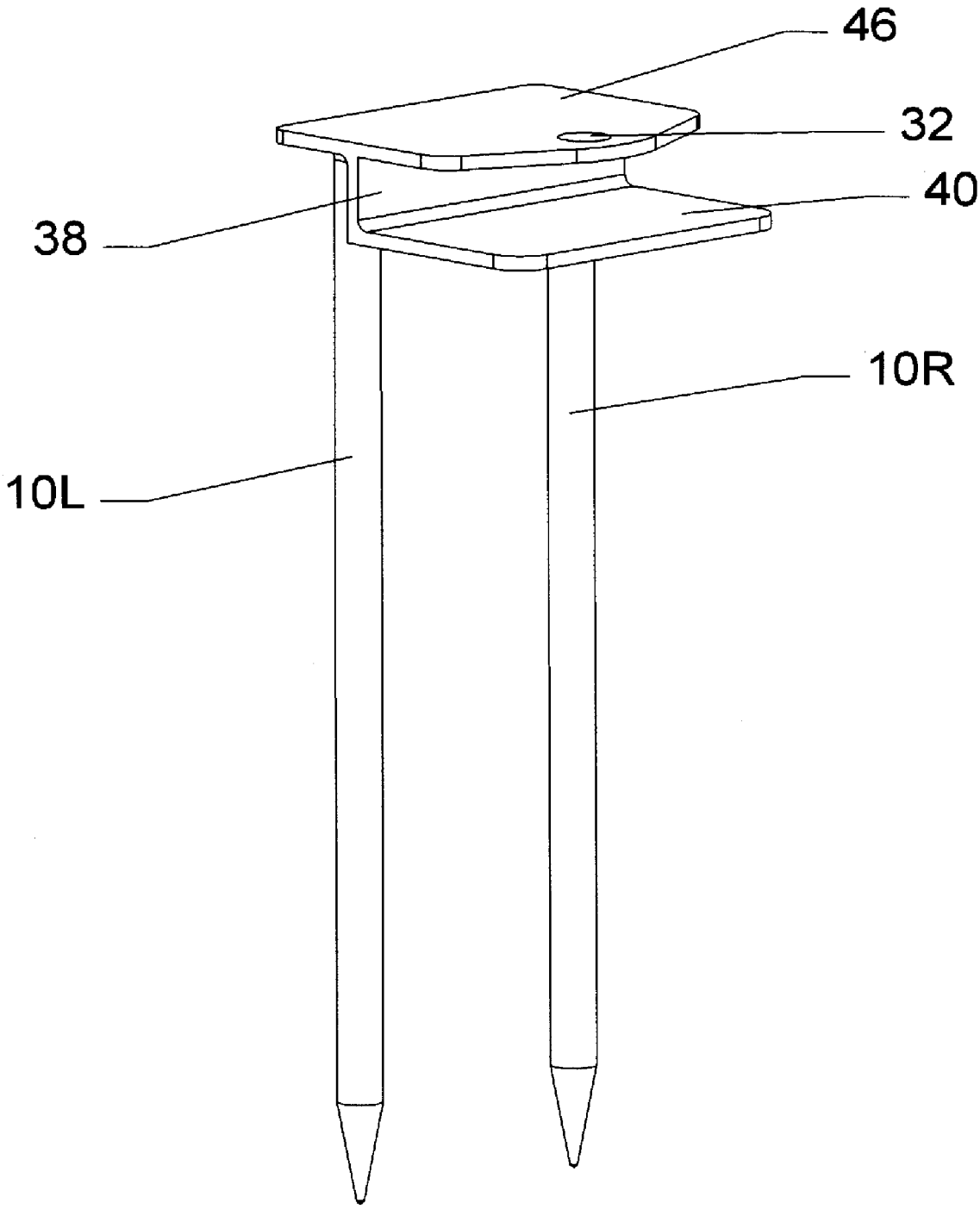
FIG. 31 shows a twentieth embodiment: an anchor with three tines and tie loop in an upper plate.

The embodiment in FIG. 30 is similar in size and construction to the embodiment shown in FIGS. 28 and 29, with the addition of a hammer 64 that is slidably mounted on a shaft 68. A flared stop 66 is located at the top end of shaft 68. The bottom end of shaft 68 is formed into a rotatably-fitting circle around a retaining pin 30. Plate 46 has two downwardly projecting members 61 and 62. Pin 30 is secured to plate 46 by a friction fit in holes placed at mirror-image locations in members 61 and 62.

In an alternative embodiment (not shown), the bottom end of shaft 68 is simply cut off so that shaft 68 is straight. Pin 30 is not used and shaft 68 is simply inserted into a blind hole in plate 46. Operation of this alternative embodiment of the anchor is otherwise the same as for the embodiment previously described.

Operation—FIG. 30

Insertion: Tips 12 of tines 10 are placed in contact with the ground (not shown). Shaft 68 is rotated to its full upright position, as shown. Hammer 64 is first gripped by the user and raised to a position away from plate 46. Then hammer 64 is forcibly brought down into contact with plate 46, driving the anchor downward into the ground. These hammer blows are repeated until plate 44 rests firmly on the ground. Stop 66 prevents separation of hammer 64 from shaft 68 when hammer 64 is raised. After the anchor is installed, shaft 68 is optionally rotated around the axis of pin 30 and allowed to rest, out of the way, on the ground.

Removal: When the ground is not particularly hard, the anchor can be simply lifted out. When the ground is especially hard or firm, hammer 64 is used in removal of the anchor. Shaft 68 is first rotated to an upright position. Hammer 64 is then forcibly lifted upward into contact with stop 66. When hammer 64 strikes stop 66, the upward momentum of hammer 64 is transferred to the anchor, causing tines 10 to slidably move upward in the ground. These blows are repeated until the anchor is out of the ground. Hammer blows can also be applied at an angle by raising shaft 68 to less than its full upright position for hammering against stop 66. The sideways force component of blows applied at an angle with respect to tines 10 serve to weaken the hold of the ground on the tines.

The slide hammer embodiments are useful in larger models as they eliminate the need for a separate hammering device.

DESCRIPTION AND OPERATION—20TH EMBODIMENT—FIG. 31

This alternative version of the embodiment shown in FIG. 28 has only two tines, 10L and 10R. Top members 38 and 40, and plate 46 are optionally decreased in size, relative to those shown in FIG. 28, to accommodate the decrease in tine volume of this version.

This embodiment is driven into the ground by blows or pressure applied to member 46. Force is applied until member 40 rests firmly on the ground. Although only two tines are used, this embodiment is still not subject to twist under load.

DESCRIPTION AND OPERATION—21ST EMBODIMENT—FIG. 32

Figure 32:
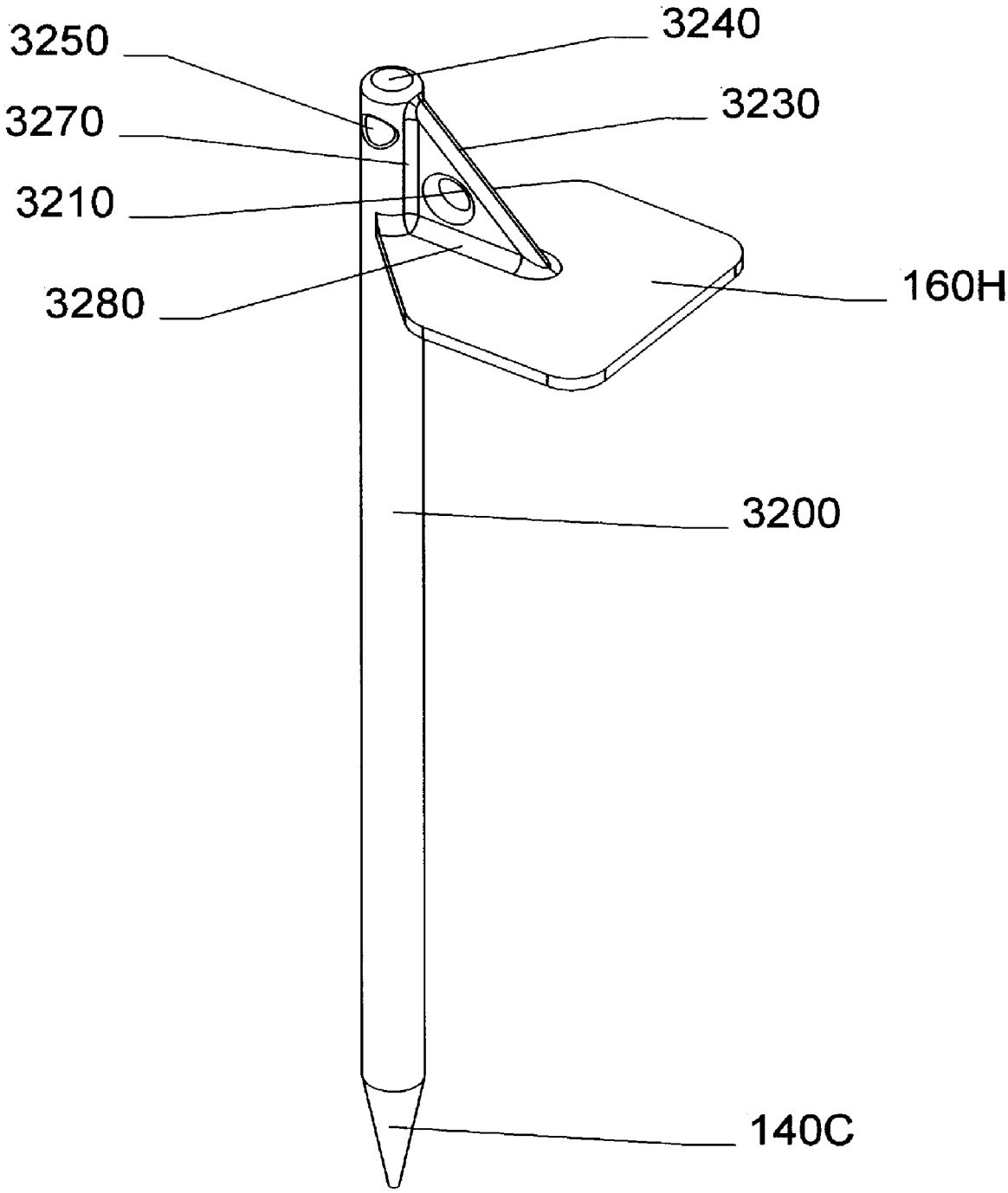
FIG. 32 shows a twenty-first embodiment: a single ground peg and a compression plate having a tie hole in an above-strut.

The embodiment shown in FIG. 32 comprises a single tine 3200 with a sharpened tip 140C at one end, a top 3240 and an optional hole 3250 at the other end. A plate 160H is attached to tine 3200 by a brace 3230 held in place by welded or soldered fillets 3270 and 3280. Brace 3230 further includes a hole 3210 for attaching a hawser (not shown). This embodiment is optionally made of a metal such as mild steel, stainless steel, or aluminum. It is optionally larger and more robust than the similar version shown in FIG. 1.

This embodiment is driven into the ground by blows applied to top 3240 or pressure applied to plate 160H. Tip 140C advances into the ground until plate 160H rests firmly on the surface. In use, one or more hawsers (not shown) are secured at holes 3210 and 3250.

DESCRIPTION—22D EMBODIMENT—FIG. 33

Figure 33:
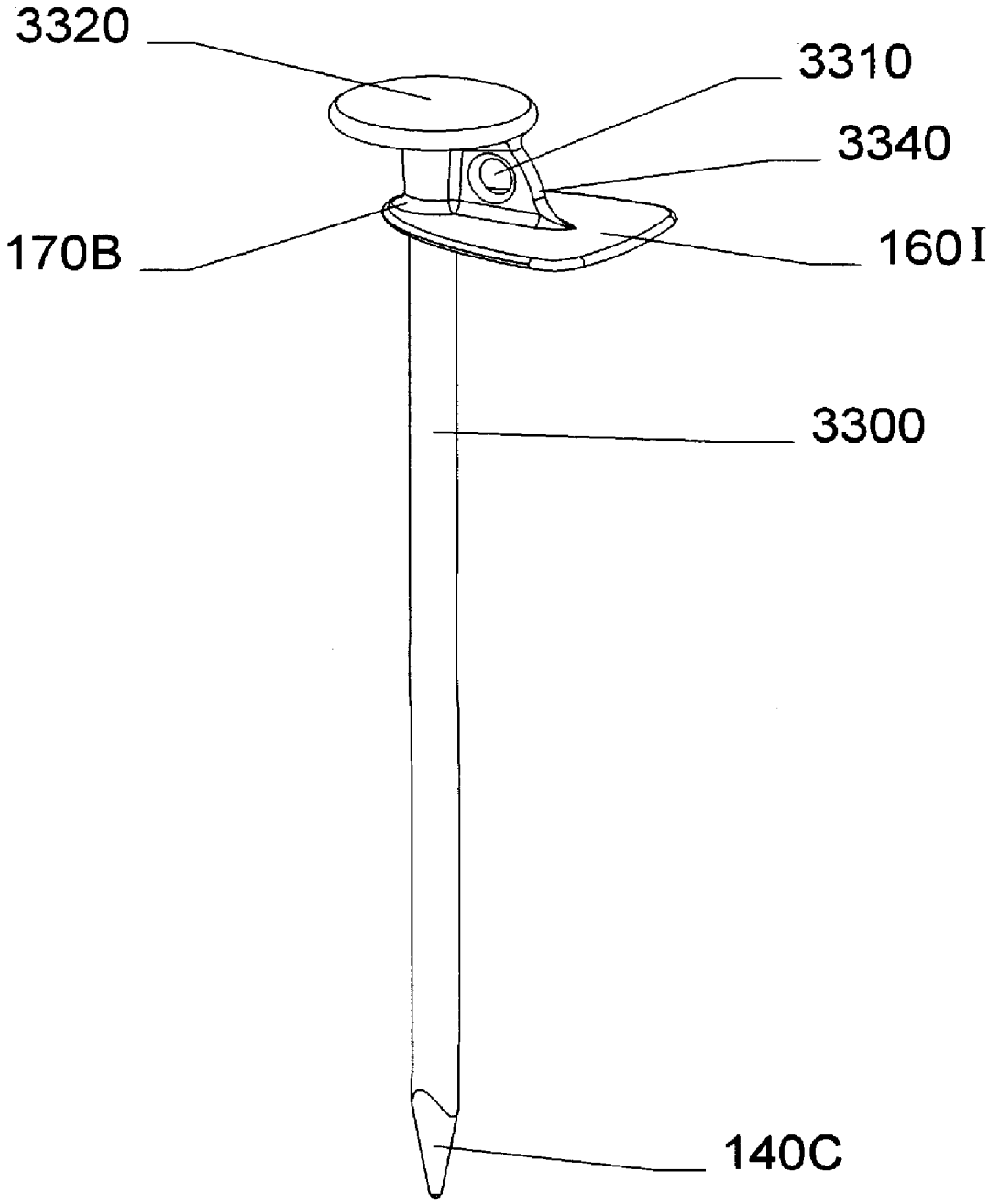
FIG. 33 shows a twenty-second embodiment: a sand peg with a top striking surface and a compression plate with a connecting strut having a tie hole.

FIG. 33 shows a single tine embodiment suitable for use as a shore or sand anchor. This embodiment comprises a single tine 3300 with a sharpened tip 140C at the bottom end and a hand or foot plate 3320 at the top end. A plate 160I is attached at the top end of tine 3300, beneath plate 3320. A brace 3340 with a hole 3310 is secured between plate 160I and plate 3320 by a joint or fillet 170B. This embodiment is between 25 cm and 50 cm in length, although any size can be used, depending on the load to be secured to the ground. Plate 3320 is typically between 4 cm and 8 cm in diameter, although other sizes can be used. The cross-section of tine 3300 can be elliptical, round, square, star-shaped, pentagonal, and the like to reduce twisting in the ground during and after installation.

OPERATION—22D EMBODIMENT—FIG. 33

Tine 3300 is driven into the ground by pressure or blows applied to plate 3320. When fully installed, plate 160I rests firmly on the ground. A hawser is secured through hole 3310. This embodiment is suitable for a variety of uses, including anchoring small marine craft such as personal watercraft, inflatable boats, and the like.

DESCRIPTION—23D EMBODIMENT—FIG. 34

Figure 34:
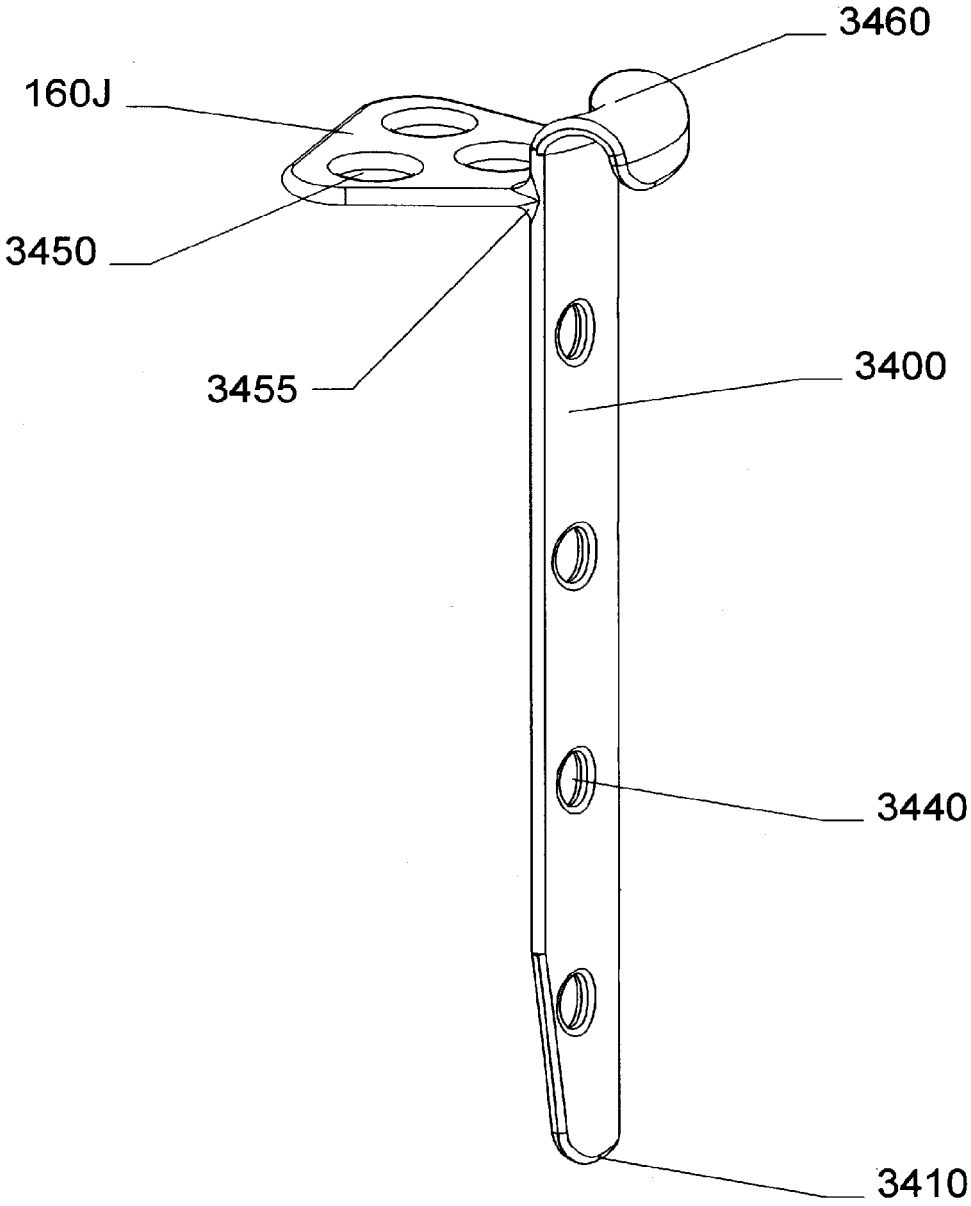
FIG. 34 shows a twenty-third embodiment: a snow peg comprising a flat peg with holes and a compression plate with holes.
Figure 35:
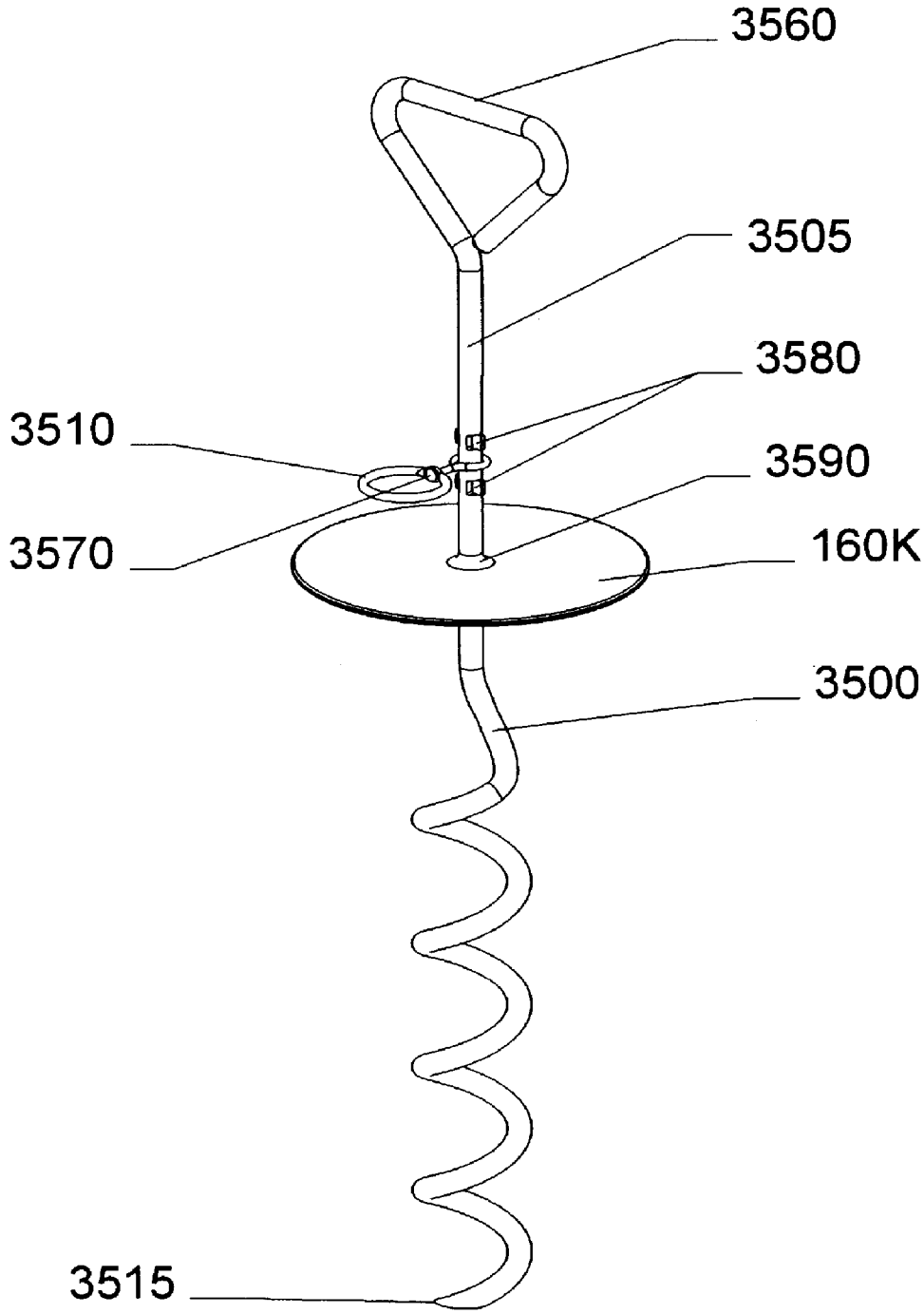
FIG. 35 shows a twenty-fourth embodiment: a spiral or pig-tail peg with a round compression plate.

FIG. 34 shows a single-tined snow stake or peg for use in snow camping and other snow activities, and also sand. A tine 3400 comprises a flat or V-shaped body with a tip 3410 at the bottom, and a number of holes 3440. A plate 160J, also with holes 3450, is secured by a fillet 3455 near the top end of tine 3400. Tine 3400 continues upward approximately 2 cm past plate 160J into a downwardly depending, curved termination 3460, about 2 cm long and approximately the width of tine 3400. One version of this embodiment is between 25 and 30 cm long, and between 3 and 5 cm wide although other sizes can be used. Plate 160J is typically between 3 and 8 cm wide at its widest point. Holes 3440 and 3450 are typically between 0.5 and 1 cm in diameter, although other sizes can be used. This stake can be made of metals such as aluminum or steel, or plastics. Because of their high thermal conductivity, the metals and some plastics promote the formation of ice in holes 3440 and 3450 by removing heat from around the anchor.

OPERATION—TWENTY-THIRD EMBODIMENT—FIG. 34

This embodiment is installed into snow, sand, or the ground by applying pressure to the top of plate 160J, curved portion 3460, or both, until plate 160 rests on top of or just beneath the surface of the terrain. A hawser is secured beneath curved portion 3460. In snow, ice tends to form in holes 3440 and 3450 (if holes 3450 are buried beneath the surface), linking the snow on both sides of tine 3400 and plate 160J. Additionally, plate 160J rests on the hard ice crust on the top of the snow. These factors contribute to a strong and reliable anchoring.

DESCRIPTION—24TH EMBODIMENT—FIG. 35

In this embodiment, a ground compression plate 160K is added to a prior-art helicoidal-tine anchor. This anchor comprises a handle 3560, a helicoidal tine 3500 with a straight shaft portion 3505. Plate 160K is secured to portion 3505 by a rotating joint, weld, brazing, solder, glue, or compression fillet 3590. A swivel ring 3510 is pivotably attached to an eye hook 3570 that is pivotably attached to the shaft portion 3505 of tine 3500. Hook 3570 is suspended between two stops 3580 on shaft portion 3505 above plate 160K to allow free rotation and pivoting of ring 3510 without interference from the ground. Plate 160K is optionally made of plastic or metal and is typically 10 cm in diameter and 1.5 mm thick, although other sizes are usable too, depending on the type of terrain in which the anchor is used. In loose terrain, such as sand, the diameter of plate 160K is larger. In firm terrain, such as compacted clay, a smaller diameter of plate 160K will suffice.

OPERATION—24TH EMBODIMENT—FIG. 35

To prepare the anchor for use, tip 3515 of tine 3500 is forced against the ground while the user turns handle 3560 in a clockwise direction. The anchor is advanced into the ground by the helicoidal screw portion of tine 3500 until plate 160K rests firmly on the surface of the ground. At this point, the user stops turning handle 3560 to avoid churning, and therefore loosening, of the soil by the continued rotation of tine 3500. A hawser, animal leash, and the like is then attached to ring 3510.

CONCLUSION, RAMIFICATIONS, AND SCOPE

Accordingly the reader will see that, according to the invention, I have provided a ground anchor or stake system for anchoring boats and other articles firmly to the ground that provides good anchoring power due to synergistic interaction between the forces exerted by tines and compression or stabilizing plates. When the stake is fully inserted, the compression plate first compresses the soil around the stake. When a load pulls against the stake, the compression plate further compresses the soil beneath, thereby strengthening the holding power of the stake. Numerous configurations of the stake accommodate a wide variety of soils. A narrow, inherently flexible stake secures objects in sand, for example. Multiple tines prevent rotation of the stake. Tine cross-sections other than circular reduce the tendency of the stake to rotate. Stakes can be driven into hard soil with a hammer or mallet. A variety of tie point configurations secure ropes for various needs. Some tie points are open, others are closed. A swivel design permits free-swiveling motion of a tie-off rope. Also it is less susceptible to loss of critical parts, is quick and easy to insert and retract with no special tools, reduces the chance of wear on hawser or ship due to contact with anchor, has few or no moving parts and therefore has little potential for malfunction caused by wear or jamming, is small, compact, lightweight, and easily storable, is useable in a variety of soil types and conditions, has a simple design that is conducive to easy manufacture, and is lightweight, durable, and designed so that the forces that are exerted by the hawser on the anchor are efficiently transformed into soil compression forces.

While the above description contains many specificities, these should not be construed as limitations on the scope of the invention, but as exemplifications of the embodiments thereof. Many other ramifications and variations are possible within the teachings of the invention. For example, while the tines are most efficient when narrow and able to flex, the addition of a compression plate to virtually any stake or peg inserted at an angle of 90-degrees will dramatically improve its performance; thus all embodiments perform satisfactorily. Although the ground anchors have been described with reference to beachside anchoring of pleasure craft and the like, anchors according to the invention may be employed for a variety of purposes in various soil conditions. For example, other applications for the anchor include anchoring of light aircraft, helicopters and the like, tent staking, agricultural staking, garden staking, tree staking or anchoring to enable winching of motor vehicles bogged down in sandy soils. Scaled-up versions of the anchor that preserve the design can also serve in a variety of civil engineering applications. In the vessel anchoring applications the ground anchor's tines will be inserted straight down into the sand surface. In other applications where the tension on the hawser is more vertical, such as the anchoring of aircraft, tent staking, and so forth, the ground anchor's tines may be inserted some 20 to 30 degrees off vertical to compensate for the higher angle of tension on the hawser. In this case, a small hole should be dug that is shaped so that stabilizing member 26 (FIG. 9) rests completely against a sloping soil surface within the hole. While all the figures show ground anchors with three tines, two-tine and four or more-tine versions are also possible. However, anchors with more than three do not presently seem as desirable. In lieu of tines, in some instances a flat vertical plate can be substituted. Instead of metal or GRP, the stakes can be made of wood or rigid plant shoots. More or fewer, larger and smaller tie points can be used. Although use with tents and the like is described, many other uses are possible including providing ground anchors for boats and other vehicles, balloons, and so forth. The parts can be attached together by means other than lugs or welds, such as staking, adhesive, integral forming, etc. The plate can be attached to the tine at an angle of 90 degrees or an acute angle. The spring (FIG. 16) can be a coil or other type of spring. The dimensions can be varied widely. Adjustable-height support plates can be oval, square, rectangular, star-shaped, or other shapes instead of circular. Instead of holes in both the plates and stake, set screws can be provided in the plate which can be tightened against the stake at any vertical position. Instead of being attached to the compression plate, the upper, tubular portion of the compression plate can be a separate part which can press down on the compression plate, securing the compression plate in position.

While the present system employs elements which are well known to those skilled in the art of ground anchor design, it combines these elements in a novel way which produces new results not heretofore discovered. Accordingly the scope of this invention should be determined, not by the embodiments illustrated, but by the appended claims and their legal equivalents.

The invention claimed is:

1. A ground anchor stake that is more resistant to pullout, especially in sandy soil, comprising:

a. at least one elongated tine with top and bottom ends, said bottom end having a tip to facilitate pushing said tine into the ground, b. a compression plate attached near said top end of said tine, said compression plate being oriented at an angle of 90 degrees or acute to the portion of said tine below said compression plate, c. said compression plate having a portion extending on one side of said tine, said portion being called a forward portion, d. said forward portion of said compression plate having upper and lower opposing surfaces, said lower surface being a ground-contacting surface that is free of any extending tines so that said lower surface can be urged freely against the ground, e. at least one hawser tie opening attached above and adjacent said upper surface of said compression plate for enabling a hawser or tie to be secured to said ground anchor stake, said hawser tie opening being spaced above said compression plate by a distance that is smaller than the length of said forward portion of compression plate, f. said tie opening being positioned on said forward side of said tine and to the rear of said forward portion of said compression plate so that a pull on said hawser or tie when said tine is inserted in the ground will tend to force said ground-contacting surface of said compression plate down against the ground to compress said ground beneath said ground-contacting surface to restrain forward rotation of said tine, g. said elongated tine being able to flex or bend when said tine is driven into the ground and said hawser exerts a pull on said hawser tie opening, whereby when said tine is driven at an angle of substantially 90° or less to the surface of the ground until said lower surface of said compression plate contacts said ground, and said hawser exerts a pull on said hawser tie opening, said tine will bend and said plate will move forward and down slightly as said pull is applied due to the inherent flex in the tine and said ground-contacting surface of said compression plate will press against said ground beneath said ground-contacting surface, thereby to aid said stake in resisting pullout from said ground.

2. The ground anchor stake of claim 1 wherein said tine comprises a relatively long main portion, a bight portion, and a forward portion, the top of said main portion being connected to said bight portion, said bight portion extending around and down toward said bottom end of said tine and being connected to said forward portion, said forward portion being shorter than said main portion of said tine, said compression plate being attached to said forward portion and extending back to and around said main portion without attachment to said main portion so as to form said hawser tie opening of said bight portion and said compression plate, whereby said main portion is able to flex without inhibition and a pull from a hawser will urge said compression plate against the ground when said main portion is driven into the ground at a substantially 90° angle.

3. The anchor of claim 1 wherein said tip is selected from the group consisting of pointed and wedge-shaped members.

4. The anchor of claim 1, further including a second tine, shorter than said first-named tine, connected to and extending beneath said compression plate.

5. The anchor of claim 1 wherein said angle is 90 degrees.

6. The anchor of claim 1 wherein the said angle is acute.

7. The anchor of claim 1, further including an expansion plate affixed and parallel to said compression plate, said expansion plate being larger than said compression plate.

8. The anchor of claim 1 wherein said expansion plate is made of a material selected from the group consisting of metal and plastic.

9. The anchor of claim 1 wherein said elongated tine is made of a material selected from the group consisting of metal, plastic and plant material.

10. The anchor of claim 1 wherein said hawser tie opening comprises a bight loop formed in the intersection between said compression plate and the top portion of said tine.

11. The anchor of claim 1 wherein said hawser tie opening comprises at least one hook extending from a position near said top end of said tine, and lying above said compression plate.

12. The anchor of claim 1 wherein said hawser tie opening comprises a neck and a top, both lying above said compression plate.

13. The anchor of claim 12 wherein said hawser tie opening further includes a second tie point extending from said top downward to said compression plate.

14. The anchor of claim 1 wherein said hawser tie opening comprises at least one hole.

15. The anchor of claim 14 wherein said hawser tie opening is located in said compression plate.

16. The anchor of claim 14 wherein said hawser tie opening is located in said tine, above said compression plate.

17. The anchor of claim 1 wherein said hawser tie opening is a tie-off bar.

18. The anchor of claim 1 wherein said hawser tie opening is a hook extending from the top surface of said compression plate.

19. The anchor of claim 1 wherein said tine further includes at least one first hole into which a pin can be inserted, said compression plate further includes a tubular portion attached to a top side of said compression plate and provided with at least one second hole for accommodating said pin so that said pin attaches said compression plate to said tine yet can be slidably moved up and down on said tine, whereby said tine can be driven a variable distance into the ground and said compression plate can be slidably moved downward on said tine until said compression plate contacts said ground, and said pin is inserted into said first and second holes, thereby holding said compression plate against said ground.

20. The anchor of claim 19 wherein the cross-section of said tine is selected from the group consisting of star-shaped, round and square.

21. The ground anchor of claim 1 wherein said long main portion, said bight portion, and said forward portion of said tine are formed by bends in a continuous bar.

22. A method for more securely anchoring an anchor subject to a pull load to the ground, especially in sandy soil, comprising:

providing a stake comprising at least one elongated tine with top and bottom ends and a tip at said bottom end to facilitate pushing said stake into the ground, providing a compression plate attached to said tine near the top of said tine, said compression plate having a forward side extending on one side of said tine, said one side of said tine being called a forward side of said tine, said compression plate forming an angle of 90 degrees or an acute angle with the portion of said tine below said compression plate, said portion of said compression plate extending on said forward side of said tine called a forward portion, said forward portion having upper and lower opposing surfaces, said lower surface being a ground-contacting surface that is free of any extending tines so that said lower surface can be urged freely against the ground, providing at least one hawser tie opening attached above and adjacent said upper surface of said compression plate for enabling a hawser or tie to be secured to said ground anchor stake, said hawser tie opening being positioned on said forward side of said tine and behind said forward side of said compression plate so that a pull on said hawser or tie when said stake is inserted in the ground will tend to force the bottom side of said forward side of said compression plate against the ground to compress said ground beneath said ground-contacting surface to restrain forward rotation of said tine, said hawser tie opening being spaced above said compression plate by a distance that is smaller than the length of said forward portion of compression plate, driving said stake, tip-first, tip into the ground until said compression plate contacts said ground and so that said stake is oriented at an angle of substantially 90° to the surface of said ground, said stake being free to flex or bend along its length under a load applied to said hawser after said stake is driven into the ground, whereby when said hawser exerts a pull on said hawser tie opening, said stake will bend and said plate will move forward and down slightly as said pull is applied until said plate contacts the ground, thereby to compress said ground and further aid said stake in resisting pullout from said ground.

23. The method of claim 22 wherein said stake comprises a relatively long main portion, a bight portion, and a forward portion, the top of said main portion being connected to said bight portion, said bight portion extending around and down toward said bottom end of said stake and being connected to said forward portion, said forward portion being shorter than said main portion of said stake, said compression plate being attached to said forward portion and extending back to and around said main portion without attachment to said main portion so as to form said hawser tie opening of said bight portion and said compression plate, whereby said main portion is able to flex without inhibition and a pull from a hawser will urge said compression plate against the ground when said main portion is driven into the ground at a substantially 90° angle.

24. The method of claim 23, further including a second shortened tine extending beneath said compression plate.

25. The method of claim 23 wherein said angle is 90 degrees.

26. The method of claim 23 wherein said angle is acute.

27. The method of claim 23 wherein said long main portion, said bight portion, and said forward portion of said tine are formed by bends in a continuous bar.

28. The method of claim 22 wherein said tip is selected from the group consisting of pointed and wedge-shaped members.

29. A ground anchor that is more resistant to pullout, especially in sandy soil, comprising:

a. a stake including at least one elongated tine having bottom and top ends with a tip at said bottom end to facilitate pushing said tine into the ground, b. ground compression means attached to said tine for compressing said ground adjacent said tine, said ground compression means comprising a compression plate forming an angle of 90 degrees or acute with the portion of said tine below said compression plate, said plate extending from one side, called a forward side, of said tine, the portion of said plate extending from said forward side of said tine called a forward portion, the lower surface of said forward portion being a ground-contacting surface that is free of any extending tines so that said lower surface can be urged freely against the ground, c. said tine comprising a relatively long main portion, a bight portion, and a forward portion, the top of said main portion being connected to said bight portion, said bight portion extending around and down toward said bottom end of said tine and being connected to said forward portion, said forward portion being shorter than said main portion of said tine, d. said compression plate being attached to said forward portion of said tine and extending back to and around said main portion of said tine without attachment to said main portion of said tine so as to form a hawser tie opening of said bight portion and said compression plate, whereby said main portion is able to flex without inhibition and a pull from a hawser will urge said compression plate against the ground when said main portion is driven into the ground at a substantially 90° angle, said hawser tie opening being spaced above said compression plate by a distance that is smaller than the length of said forward portion of compression plate, e. said elongated tine being able to flex or bend under a load applied to said hawser tie opening when said tine is driven into the ground at a substantially 90° angle to the surface of the ground, whereby when said hawser exerts a pull on said hawser tie opening means, said tine will bend and said plate will move forward and down slightly so as to contact and compress the ground as said pull is applied due to the inherent flex in the tine, thereby to further aid said stake in resisting pullout from said ground.

30. The ground anchor of claim 29 wherein said long main portion, said bight portion, and said forward portion of said tine are formed by bends in a continuous bar.

* * * * *